US012635840B2

(12) United States Patent
Kim et al.

(10) Patent No.: US 12,635,840 B2
(45) Date of Patent: May 26, 2026

(54) METHOD OF CONTROLLING CLEANING ROBOT TO AVOID LIQUID OBJECT, AND CLEANING ROBOT THEREFOR

(71) Applicant: Samsung Electronics Co., Ltd., Suwon-si (KR)

(72) Inventors: Juyong Kim, Yokohama (JP); Katsunori Araki, Yokohama (JP); Motonari Sakurai, Yokohama (JP); Ritsuya Yamamoto, Yokohama (JP); Takaaki Katsuura, Yokohama (JP)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 34 days.

(21) Appl. No.: 18/678,994

(22) Filed: May 30, 2024

(65) Prior Publication Data

US 2024/0315507 A1 Sep. 26, 2024

Related U.S. Application Data

(63) Continuation of application No. PCT/KR2023/018774, filed on Nov. 21, 2023.

(30) Foreign Application Priority Data

Nov. 21, 2022 (JP) ..... 2022-185962
Oct. 31, 2023 (JP) ..... 2023-186643

(51) Int. Cl.
*A47L 9/28* (2006.01)
*A47L 11/40* (2006.01)

(52) U.S. Cl.
CPC ..... *A47L 9/2826* (2013.01); *A47L 11/4011* (2013.01)

(58) Field of Classification Search
CPC .. A47L 9/2826; A47L 11/4011; A47L 9/2805; A47L 9/2852; A47L 9/28;
(Continued)

(56) References Cited

U.S. PATENT DOCUMENTS 9,399,284 B2 7/2016 Kwon et al.
10,111,566 B2 10/2018 Ahn et al.
(Continued)

FOREIGN PATENT DOCUMENTS

JP 2018-509595 4/2018
JP 2018-515191 6/2018
(Continued)

OTHER PUBLICATIONS

International Search Report and Written Opinion dated Feb. 28, 2024 for International Application No. PCT/KR2023/018774.
(Continued)

*Primary Examiner* — Brodie J Follman
(74) *Attorney, Agent, or Firm* — STAAS & HALSEY LLP

(57) ABSTRACT

A cleaning robot including a cleaning module; a traveling module to move the cleaning robot on a surface to be cleaned; a light emission unit; an infrared light sensor; a visible light sensor; and at least one processor configured to execute instructions to control the light emission unit to emit infrared light toward a detection region, control the infrared light sensor to receive the emitted infrared light that is reflected from the detection region, control the visible light sensor to receive visible light reflected from the detection region, determine, based on the reflected visible light and an intensity of the reflected infrared light, whether a liquid object is present in the detection region, control, based on determining that the liquid object is present, the traveling module to move the cleaning robot to avoid the liquid object,
(Continued)

and control the cleaning module to clean the surface while the cleaning robot moves.

17 Claims, 25 Drawing Sheets

(58) Field of Classification Search
CPC ..... A47L 11/4061; B25J 9/16; B25J 11/00; B25J 13/08; B25J 19/02; G05D 1/20
See application file for complete search history.

(56) References Cited

U.S. PATENT DOCUMENTS

| | | | | |
|---|---|---|---|---|
| 10,247,669 | B2 | 4/2019 | Windorfer | |
| 10,314,452 | B2 | 6/2019 | Izawa et al. | |
| 10,368,708 | B2 | 8/2019 | Cornelissen | |
| 11,278,172 | B2 | 3/2022 | Yang et al. | |
| 11,385,653 | B2 | 7/2022 | Vicenti | |
| 11,422,566 | B2 | 8/2022 | Chae | |
| 11,471,016 | B2 | 10/2022 | Hong et al. | |
| 11,513,525 | B2 | 11/2022 | Eoh et al. | |
| 2019/0204847 | A1 | 7/2019 | Noh et al. | |
| 2019/0343354 | A1* | 11/2019 | Hong et al. | A47L 9/281 |
| 2021/0026369 | A1 | 1/2021 | Izawa et al. | |
| 2021/0389772 | A1 | 12/2021 | Kim et al. | |
| 2022/0083067 | A1 | 3/2022 | Yoshida et al. | |
| 2022/0178842 | A1 | 6/2022 | Wang et al. | |
| 2023/0057584 | A1 | 2/2023 | Kim | |
| 2024/0310851 | A1* | 9/2024 | Afrouzi et al. | A47L 9/0477 |

FOREIGN PATENT DOCUMENTS

| | | | | |
|---|---|---|---|---|
| JP | 2018-132810 | | 8/2018 | |
| JP | 6729997 | | 7/2020 | |
| JP | 2022-025678 | | 2/2022 | |
| JP | 7221549 | | 2/2023 | |
| JP | 2023-038857 | | 3/2023 | |
| KR | 10-2015-0065972 | | 6/2015 | |
| KR | 10-2016-0058594 | | 5/2016 | |
| KR | 20160126968 | A * | 11/2016 | A47L 11/4011 |
| KR | 10-2019-0081316 | | 7/2019 | |
| KR | 10-2019-0096874 | | 8/2019 | |
| KR | 10-2015325 | | 8/2019 | |
| KR | 10-2019-0129673 | | 11/2019 | |
| KR | 20190129673 | * | 11/2019 | A47L 9/2826 |
| KR | 10-2021-0094961 | | 7/2021 | |
| KR | 10-2022-0112555 | | 8/2022 | |
| KR | 10-2023-0148716 | | 10/2023 | |
| WO | WO 2016/173919 | A1 | 11/2016 | |
| WO | WO 2020/093381 | A1 | 5/2020 | |

OTHER PUBLICATIONS

International Search Report and Written Opinion dated Nov. 3, 2023 for International Application No. PCT/KR2023/011506.
Extended European Search Report dated Nov. 11, 2025 for EP Patent Application No. 23894996.0.

* cited by examiner

METHOD OF CONTROLLING CLEANING ROBOT TO AVOID LIQUID OBJECT, AND CLEANING ROBOT THEREFOR

CROSS-REFERENCE TO RELATED APPLICATIONS

This application is a continuation application, under 35 U.S.C. § 111(a), of International Application No. PCT/KR2023/018774, filed on Nov. 21, 2023, which claims priority under 35 U.S.C. § 119 to Japanese Patent Application No. 2022-185962, filed on Nov. 21, 2022, and Japanese Patent Application No. 2023-186643, filed on Oct. 31, 2023, the disclosures of which are incorporated by reference herein in their entireties.

TECHNICAL FIELD

The present disclosure relates to a cleaning robot and an operating method thereof. More particularly, the present disclosure relates to a method, performed by a cleaning robot, of detecting a liquid object on a surface to be cleaned and moving to avoid the liquid object, and to a cleaning robot for performing the method.

BACKGROUND ART

Recently, robots capable of automatically cleaning a floor while moving to avoid obstacles (i.e., self-driving cleaning robots, hereinafter also simply referred to as cleaning robots) have been attracting attention. General cleaning robots perform cleaning by sweeping up dust with a brush and sucking it in, but cleaning robots that perform cleaning by wiping away dirt with a mop or the like, or cleaning robots with a combination of such cleaning methods have also been put into practical use.

With advances in computer technology, cleaning robots are able to detect indoor obstacles, such as furniture, home appliances, or interior decorations, with relatively high precision, and travel on a floor while avoiding such obstacles.

DISCLOSURE

Technical Solution

Aspects of embodiments of the disclosure will be set forth in part in the description which follows and, in part, will be apparent from the description, or may be learned by practice of the presented embodiments.

According to an embodiment of the disclosure, a cleaning robot includes a cleaning module; a traveling module configured to move the cleaning robot on a surface to be cleaned; a light emission unit; an infrared light sensor; a visible light sensor; and at least one processor configured to execute the one or more instructions to control the light emission unit to emit infrared light toward a detection region on the surface to be cleaned in front of the cleaning robot, control the infrared light sensor to receive the emitted infrared light that is reflected from the detection region, control the visible light sensor to receive visible light reflected from the detection region, determine, based on the reflected visible light received by the visible light sensor and an intensity of the reflected infrared light received by the infrared light sensor, whether a liquid object is present in the detection region, control, based on determining that the liquid object is present in the detection region, the traveling module to move the cleaning robot to avoid the liquid object, and control the cleaning module to clean the surface to be cleaned while the cleaning robot is moved to avoid the liquid object.

According to an embodiment of the disclosure, the at least one processor may be configured to calculate, based on the intensity of the reflected infrared light received by the infrared light sensor, a reflectance of the infrared light emitted from the light emission unit, and determine, based on the reflected visible light received by the visible light sensor and whether the calculated reflectance of the infrared light emitted from the light emission unit is greater than or equal to a threshold reflectance, whether the liquid object is present in the detection region.

According to an embodiment of the disclosure, the light emission unit may include a light source at a height at which a reflectance of a surface of a liquid object in the detection region is greater than or equal to the threshold reflectance.

According to an embodiment of the disclosure, the at least one processor may be configured to control the light emission unit to emit light having, as a peak wavelength, an absorption wavelength that is determined based on absorption characteristics of water, and receive, through the infrared light sensor, infrared light with the absorption wavelength among light reflected from the detection region.

According to an embodiment of the disclosure, the absorption wavelength may range between 930 nm and 1030 nm.

According to an embodiment of the disclosure, the infrared light sensor may include a band-pass filter to block visible light and receive infrared light with the absorption wavelength.

According to an embodiment of the disclosure, the at least one processor may be configured to generate an infrared light image corresponding to the intensity of the reflected infrared light received by the infrared light sensor, generate a visible light image corresponding to the intensity of the reflected visible light received by the visible light sensor, and determine, based on the generated infrared light image and the generated visible light image, whether the liquid object is present in the detection region.

According to an embodiment of the disclosure, the at least one processor may be configured to generate a synthetic image by combining the generated infrared light image with the generated visible light image, obtain a region of the liquid object in the generated visible light image by applying the generated synthetic image to a machine learning model, and determine, based on a region of the liquid object in the generated visible light image, whether the liquid object is present in the detection region.

According to an embodiment of the disclosure, the at least one processor may be configured to output, based on determining that the liquid object is present in the detection region, a notification that the liquid object is present in the detection region.

According to an embodiment of the disclosure, the at least one processor may be configured to transmit, based on determining that the liquid object is present in the detection region, a notification, through a server to a user device, that the liquid object is present in the detection region.

According to an embodiment of the disclosure, a method of controlling a cleaning robot to avoid a liquid object, the cleaning robot including a cleaning module, a traveling module configured to move the cleaning robot on a surface to be cleaned, a light emission unit, an infrared light sensor, and a visible light sensor, the method including emitting infrared light toward a detection region on the surface to be cleaned in front of the cleaning robot; receiving, by the infrared light sensor, the emitted infrared light that is reflected from the detection region; receiving, by the visible light sensor, visible light reflected from the detection region; determining, based on the reflected visible light received by the visible light sensor and an intensity of the reflected infrared light received by the infrared light sensor, whether a liquid object is present in the detection region; controlling, based on determining that the liquid object is present in the detection region, the traveling module to move the cleaning robot to avoid the liquid object; and controlling the cleaning module to clean the surface to be cleaned while the cleaning robot is moved to avoid the liquid object.

According to an embodiment of the disclosure, the determining of whether the liquid object is present in the detection region may include calculating, based on the intensity of the reflected infrared light received by the infrared light sensor, a reflectance of the infrared light emitted from the light emission unit, and determining, based on the reflected visible light received by the visible sensor and whether the calculated reflectance of the infrared light emitted from the light emission unit is greater than or equal to a threshold reflectance, whether the liquid object is present in the detected region.

According to an embodiment of the disclosure, the emitting of the infrared light may include emitting light having, as a peak wavelength, an absorption wavelength that is determined based on absorption characteristics of water. The receiving of the infrared light reflected from the detection region may include receiving infrared light with the absorption wavelength among light reflected from the detection region.

According to an embodiment of the disclosure, the absorption wavelength may range between 930 nm and 1030 nm.

According to an embodiment of the disclosure, the infrared light sensor may include a band-pass filter to block visible light and receive infrared light with the absorption wavelength.

DESCRIPTION OF DRAWINGS

These and/or other aspects of the disclosure will become apparent and more readily appreciated from the following description of embodiments, taken in conjunction with the accompanying drawings of which.

MODE FOR INVENTION

Figure 1:
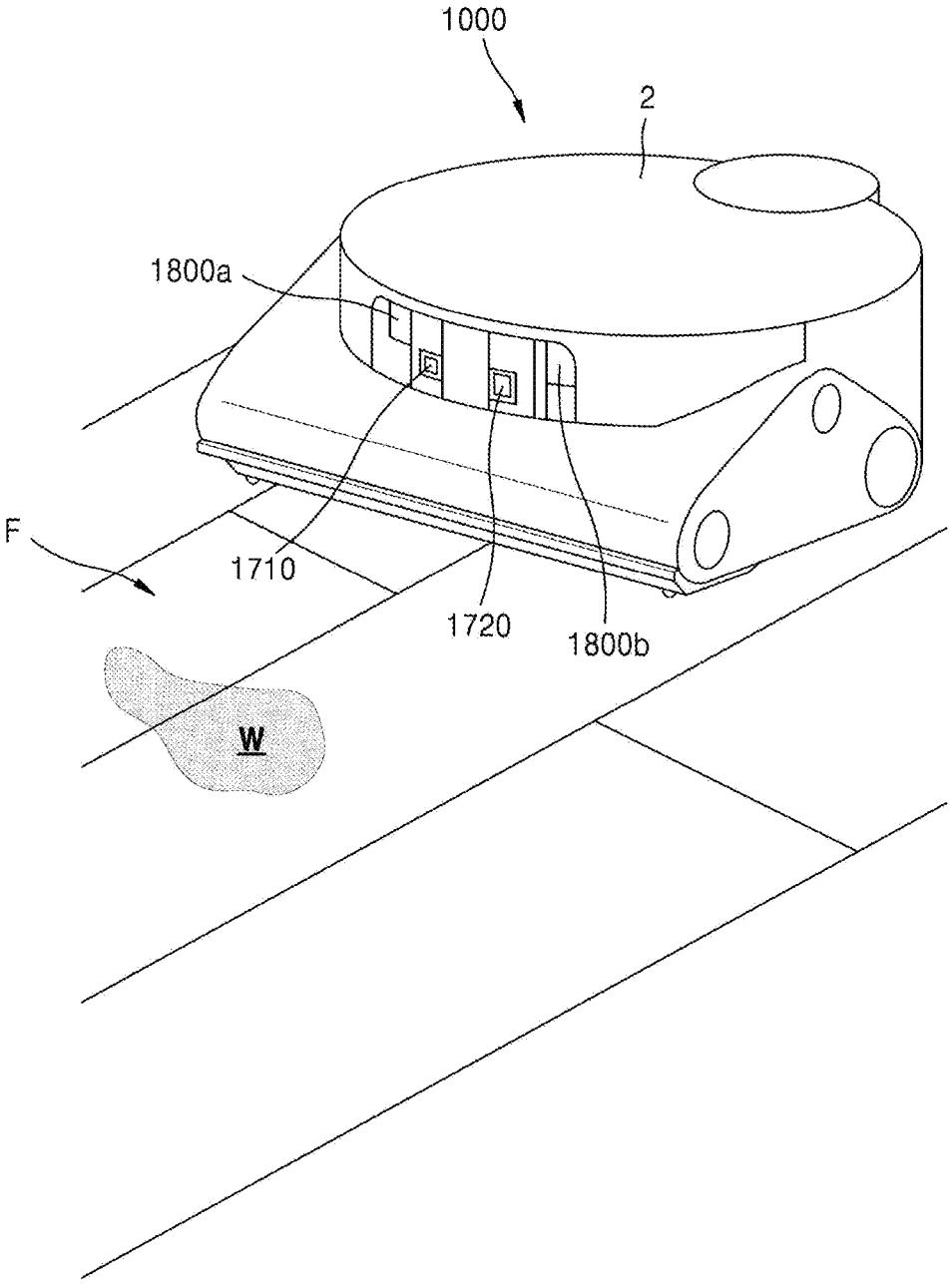
FIG. 1 illustrates a method, performed by a cleaning robot, of avoiding a liquid object on a surface to be cleaned, according to an embodiment of the present disclosure.

As used herein, the expression "at least one of a, b, or c" may indicate only a, only b, only c, both a and b, both a and c, both b and c, all of a, b, and c, or variations thereof.

Hereinafter, embodiments of the present disclosure will be described in detail with reference to the accompanying drawings to enable those of skill in the art to perform the present disclosure without any difficulty. The present disclosure may, however, be embodied in many different forms and should not be construed as being limited to an embodiment set forth herein. In addition, in order to clearly describe the present disclosure, portions that are not relevant to the description are omitted, and similar reference numerals are assigned to similar elements throughout the present specification.

Although the terms used herein are generic terms, which are currently widely used and are selected by taking into consideration functions thereof, the meanings of the terms may vary according to intentions of those of ordinary skill in the art, legal precedents, or the advent of new technology. Thus, the terms should be defined not by simple appellations thereof but based on the meanings thereof and the context of descriptions throughout the present disclosure.

In addition, terms such as 'first' or 'second' may be used to describe various elements, but the elements should not be limited by the terms. These terms are only used to distinguish one element from another element.

In addition, terms used herein are for describing a particular embodiment, and are not intended to limit the scope of the present disclosure. The singular expression also includes the plural meaning as long as it is not inconsistent with the context. In addition, throughout the present specification, when a part is referred to as being "connected to" another part, it may be "directly connected to" the other part or be "electrically connected to" the other part through an intervening element. In addition, when an element is referred to as "including" a component, the element may additionally include other components rather than excluding other components as long as there is no particular opposing recitation.

As used herein, phrases such as "in some embodiments" or "in an embodiment" does not necessarily indicate the same embodiment.

Embodiments of the present disclosure provide a cleaning robot for detecting a liquid on a surface to be cleaned, and a method of controlling the cleaning robot.

Embodiments of the present disclosure provide a cleaning robot for determining a region of a liquid on a surface to be cleaned, and a method of controlling the cleaning robot.

Embodiments of the present disclosure provide a cleaning robot for avoiding a liquid on a surface to be cleaned, and a method of controlling the cleaning robot.

FIG. 1 illustrates a method, performed by a cleaning robot 1000, of avoiding a liquid object on a surface to be cleaned, according to an embodiment of the present disclosure.

Referring to FIG. 1, the cleaning robot 1000 may determine whether a liquid object W is present on a surface F to be cleaned, based on infrared light and visible light both reflected from the surface F to be cleaned.

The surface F to be cleaned may refer to a surface to be cleaned by the cleaning robot 1000. The cleaning robot 1000 may suck in dust or trash on the surface F to be cleaned while moving on the surface F to be cleaned. The surface F to be cleaned may include, for example, a floor within a building, or a carpet, a blanket, or a mat on a floor, but is not limited thereto.

The liquid object W may refer to a substance containing liquid. The liquid may be a substance that flows freely, changes its shape according to the shape of a container, and does not have a particular shape, such as water or oil. In addition, the liquid object W may consist of only liquid such as water, oil, juice, or animal urine, or may be a substance containing liquid, such as wet food or a wet towel. In addition, the liquid object W may be in the form of a gel.

Light emission units 1800*a* and 1800*b*, a visible light sensor 1720, and an infrared light sensor 1710 may be provided on an upper front surface of a robot main body 2. The cleaning robot 1000 may determine the presence or absence of the liquid object W on the surface F to be cleaned in front of a travel path, by using the light emission units 1800*a* and 1800*b*, the visible light sensor 1720, and the infrared light sensor 1710.

According to an embodiment of the present disclosure, the cleaning robot 1000 may determine whether the liquid object W is present on the surface F to be cleaned, based on the characteristic that, when the angle of incidence is greater than or equal to a threshold angle, the reflectance of the surface of the liquid object W is greater than those of other objects than the liquid object W.

For example, the cleaning robot 1000 may control the light emission units 1800*a* and 1800*b* to emit infrared light toward the surface F to be cleaned, and receive infrared light from the surface F to be cleaned through the infrared light sensor 1710. Among the transmitted infrared light, infrared light that is not received back by the infrared light sensor 1710 may be considered as reflected infrared light.

In addition, the cleaning robot 1000 may calculate a reflectance of the infrared light based on the intensity of the received infrared light relative to the intensity of the transmitted infrared light. The cleaning robot 1000 may determine that a liquid object is present in a region of a detection region of which the reflectance is greater than or equal to a threshold reflectance. When determining the presence or absence of a liquid object based on the reflectance of the surface of the liquid object W, light sources of the light emission units 1800*a* and 1800*b* may include ultraviolet light as well as infrared light. Light sources for household use, such as fluorescent lights or white light-emitting diodes (LEDs), are visible light of approximately 400 nm to 800 nm and do not include ultraviolet light or infrared light. Thus, the cleaning robot 1000 may suppress the influence of environmental light by using ultraviolet light or infrared light to detect the liquid object W, and even when the reflectance of the liquid object W is low, the liquid object W appears relatively dark in a captured image compared to regions around the liquid object W.

According to an embodiment of the present disclosure, the cleaning robot 1000 may determine whether the liquid object W is present on the surface F to be cleaned, based on the light absorption characteristics of water according to the wavelength of light.

For example, the cleaning robot 1000 may control the light emission units 1800*a* and 1800*b* to emit light having an absorption wavelength as a peak wavelength toward the surface F to be cleaned, and receive light with the absorption wavelength among light reflected from the surface F to be cleaned, through the infrared light sensor 1710. In addition, the cleaning robot 1000 may determine whether the liquid object W is present on the surface F to be cleaned, based on the intensity of the received light with the absorption wavelength. The absorption wavelength may refer to a wavelength that has a higher light absorption rate than adjacent wavelengths according to the light absorption characteristics of water. In addition, according to an embodiment of the present disclosure, the absorption wavelength may be determined within the range of a near-infrared region. For example, the absorption wavelength may be between 900 nm and 1000 nm.

The cleaning robot 1000 may control the light emission units 1800*a* and 1800*b* to emit light having the absorption wavelength as a peak wavelength. For example, the cleaning robot 1000 may control the light emission units 1800*a* and 1800*b* to emit light in which the intensity of light with the absorption wavelength is higher than the intensity of light with adjacent wavelengths.

The cleaning robot 1000 may receive light with the absorption wavelength among light reflected from the surface F to be cleaned, through the infrared light sensor 1710.

According to an embodiment of the present disclosure, the infrared light sensor 1710 may include a band-pass filter for receiving only light with the absorption wavelength. Accordingly, the infrared light sensor 1710 may block visible light and receive light with the absorption wavelength in a near-infrared region.

When the liquid object W is present on the surface F to be cleaned, water in the liquid object W may absorb more light with the absorption wavelength than surrounding regions of the liquid object W. Accordingly, the intensity of the light with the absorption wavelength reflected from the liquid object W may be lower than the intensity of light with the absorption wavelength reflected from the surrounding regions of the liquid object W. In addition, when the intensity of the reflected light with the absorption wavelength is converted into an image, the region of the liquid object W may appear darker than the surrounding regions of the liquid object W in the image.

According to an embodiment of the present disclosure, the cleaning robot 1000 may determine a region in the converted image of which the brightness is less than the surrounding regions by a reference brightness or greater, as the region of the liquid object W. According to an embodiment of the present disclosure, the cleaning robot 1000 may determine more accurately whether the liquid object W is present on the surface F to be cleaned, considering not only infrared light but also visible light received from the surface F to be cleaned. The cleaning robot 1000 may receive visible light reflected from the surface F to be cleaned, through the visible light sensor 1720.

In an infrared light image based on infrared light with the absorption wavelength, the region of the liquid object W appears darker than the surrounding regions. In addition, in an infrared image based on angles of incidence greater than or equal to a threshold angle, the region of the liquid object W also appears darker than the surrounding regions. However, in the infrared light image, a region corresponding to a dark portion of the surface F to be cleaned or a shadow portion on the surface F to be cleaned due to the emitted light also appears dark. When the surface F to be cleaned is dark, or in order to minimize the influence of a shadow due to the emitted light, the cleaning robot 1000 may consider not only an infrared light image but also a visible light image based on visible light reflected from the surface F to be cleaned.

According to an embodiment of the present disclosure, the cleaning robot 1000 may identify whether the liquid object W is present on the surface F to be cleaned, based on a difference image between an infrared light image and a visible light image. A dark portion or a shadow portion of the surface F to be cleaned may appear dark in both the infrared light image and the visible light image, while the region of the liquid object W may appear dark in the infrared light image and may appear brighter in the visible light image than in the infrared light image. Accordingly, the cleaning robot 1000 may determine a region of the difference image of which the size is larger than those of the surrounding regions by a reference value, as the region of the liquid object W.

According to an embodiment of the present disclosure, the cleaning robot 1000 may identify whether the liquid object W is present on the surface F to be cleaned, and the region of the liquid object W on the surface F to be cleaned, based on a region of the liquid object W that is output from a machine learning model upon the infrared light image and the visible light image being input to the machine learning model as input.

According to an embodiment of the present disclosure, the cleaning robot 1000 may generate a synthetic image by combining the infrared light image with the visible light image, and identify whether the liquid object W is present on the surface F to be cleaned, and the region of the liquid object W on the surface F to be cleaned, based on a region of the liquid object W in the synthetic image that is output upon the synthetic image being input to the machine learning model as input.

According to an embodiment of the present disclosure, the cleaning robot 1000 may identify whether the liquid object W is present on the surface F to be cleaned and the region of the liquid object W on the surface F to be cleaned, based on a region of the liquid object W in the infrared light image that is output upon the infrared light image being input to a first machine learning model as input, and a region of the liquid object W in the visible light image that is output upon the visible light image being input to a second machine learning model as input.

According to an embodiment of the present disclosure, based on determining that the liquid object W is present on the surface F to be cleaned, the cleaning robot 1000 may output a notification that the liquid object W is present on the surface F to be cleaned.

According to an embodiment of the present disclosure, based on detecting the liquid object W on a travel path while moving along the travel path, the cleaning robot 1000 may change the travel path to avoid the liquid object W.

In real life, there may be cases where part of the surface F to be cleaned becomes wet due to pet urine, a spilled drink, or the like. In such cases, when the cleaning robot 1000 sucks in the liquid object W, it may malfunction due to the liquid object W sucked in. In addition, when the cleaning robot 1000 continues to travel to pass through the liquid object W, the cleaning robot 1000 may spread the dirt caused by the liquid object W.

According to an embodiment of the present disclosure, the cleaning robot 1000 may detect the presence or absence of liquid by using a pair of electrodes to which a voltage is applied. When the liquid comes into contact with the electrodes, a resistance value between the electrodes changes, and the cleaning robot 1000 may detect the presence or absence of liquid by comparing the changed resistance value with a predetermined threshold value. However, this method involves contact between the electrodes and the liquid, the cleaning robot 1000 needs to reach the liquid object W, and even when the cleaning robot 1000 stops or changes its direction after detecting the liquid object W, the cleaning robot 1000 may be unable to avoid the liquid object W.

According to an embodiment of the present disclosure, the cleaning robot 1000 may detect liquid based on only a visible light image. However, when detecting liquid based on only a visible light image, the cleaning robot 1000 cannot detect transparent liquid (e.g., pet urine or water).

According to an embodiment of the present disclosure, the cleaning robot 1000 may capture a thermal image through an infrared camera, and when a region of which the temperature is different from those of surrounding regions by a predetermined temperature difference is detected in the captured thermal image, determine the detected region as the region of the liquid object W. However, when there is almost no temperature difference between the liquid object W and the surrounding regions of the liquid object W, the cleaning robot 1000 cannot detect the liquid object W. For example, even when the surface F to be cleaned is wet with pet urine, it cannot be detected after a certain time period has elapsed.

By determining whether the liquid object W is present on the surface F to be cleaned based on the reflectance of the surface of the liquid object W when the angle of incidence is greater than or equal to a threshold angle, or by detecting whether the liquid object W is present on the surface F to be cleaned based on the light absorption characteristics of water according to the wavelength of light, the cleaning robot 1000 may identify the liquid object W with high precision even when the cleaning robot 1000 does not directly contact the liquid object W, even when there is almost no temperature difference between the liquid object W and the surrounding regions of the liquid object W, and even when the liquid object W is transparent liquid.

Figure 2:
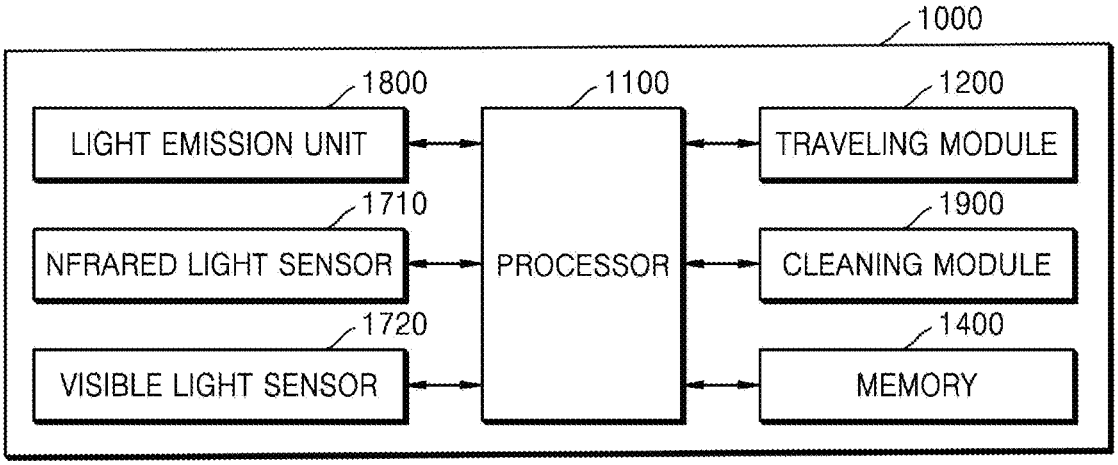
FIG. 2 illustrates a block diagram of a cleaning robot according to an embodiment of the present disclosure.

FIG. 2 illustrates a block diagram of the cleaning robot 1000 according to an embodiment of the present disclosure.

Referring to FIG. 2, the cleaning robot 1000 may include a processor 1100, a traveling module 1200, a light emission unit 1800, a memory 1400, the visible light sensor 1720, the infrared light sensor 1710, and a cleaning module 1900.

The memory 1400 stores various pieces of information, data, instructions, programs, and the like necessary for an operation of the cleaning robot 1000. The memory 1400 may include at least one of volatile memory or non-volatile memory, or a combination thereof. The memory 1400 may store a map of a region to be cleaned, and a travel path.

The processor 1100 of the cleaning robot 1000 may control the overall operation of the cleaning robot 1000. The processor 1100 of the cleaning robot 1000 may execute programs stored in the memory 1400 to control the light emission unit 1800, the traveling module 1200, the visible light sensor 1720, the infrared light sensor 1710, and the cleaning module 1900.

The cleaning robot 1000 may include at least one processor. The cleaning robot 1000 may include one processor or may include a plurality of processors. The at least one processor according to the present disclosure may include at least one of a central processing unit (CPU), a graphics processing unit (GPU), an accelerated processing unit (APU), a many-integrated core (MIC) processor, a digital signal processor (DSP), and a neural processing unit (NPU). The at least one processor may be implemented in the form of an integrated system on a chip (SoC) including one or more electronic components. Each of the at least one processor 1100 may be implemented as separate hardware (H/W). The at least one processor 1100 may be referred to as a MICOM (micro-computer, microprocessor computer, or microprocessor controller), a microprocessor unit (MPU), or a microcontroller unit (MCU).

The at least one processor 1100 according to the present disclosure may be implemented as a single-core processor or a multi-core processor.

The light emission unit 1800 may emit light. For example, the light emission unit 1800 may be provided to face a detection region on a surface to be cleaned, and emit light toward the detection region. The light emission unit may include, but is not limited to, an LED or a lamp. A light source of the light emission unit 1800 may include an infrared light source and an ultraviolet light source.

The light emission unit 1800 may include one light source, and may include a pair of light sources 1800*a* and 1800*b* as illustrated in FIG. 1. When the light emission unit 1800 includes a pair of light sources 1800*a* and 1800*b*, the pair of light sources 1800*a* and 1800*b* may be arranged at an interval in a horizontal direction.

According to an embodiment of the present disclosure, the light emission unit 1800 may include an LED light and may generate infrared light with a peak at 970 nm. For example, the light emission unit 1800 may generate infrared light between 960 nm and 980 nm with a peak at 970 nm.

The light emission unit 1800 may emit infrared light to spread radially toward a lower portion in front of the cleaning robot 1000. Accordingly, the front of the path of the cleaning robot 1000 may be illuminated approximately uniformly by the infrared light.

The infrared light sensor 1710 may receive infrared light reflected from the detection region on the surface to be cleaned.

According to an embodiment of the present disclosure, the infrared light sensor 1710 may include a band-pass filter for passing only light with an absorption wavelength in order to receive only the light with the absorption wavelength.

For example, the infrared light sensor 1710 may be implemented by removing an infrared light blocking filter from a general image sensor, which generates an image by converting the intensity of visible light into an electrical signal, and providing a band-pass filter for passing only light with the absorption wavelength. The general image sensor may be, for example, a charge-coupled device (CCD) sensor or a complementary metal-oxide-semiconductor (CMOS) sensor.

The infrared light sensor 1710 and the visible light sensor 1720 are oriented in a direction for capturing images of the detection region on the surface to be cleaned in front of the path of the robot main body. The visible light sensor 1720 and the infrared light sensor 1710 may be provided to capture images of the same detection region.

According to an embodiment of the present disclosure, the light emission unit 1800 and the infrared light sensor 1710 may be implemented as a single Time-of-Flight (ToF) sensor. The ToF sensor may include the light emission unit 1800 configured to emit infrared light and an infrared light sensor 1710 configured to receive reflected infrared light. The processor 1100 may control the light emission unit 1800 of the ToF sensor to emit infrared light toward the surface to be cleaned, and control the infrared light sensor 1710 of the ToF sensor to detect the intensity of infrared light that is reflected and then received.

By using the ToF sensor to obtain the distance between the ToF sensor and an object as well as detect the intensity of received infrared light, the cleaning robot 1000 may detect the intensity of the infrared light by using the existing ToF sensor even when the cleaning robot 1000 is not equipped with a separate infrared light source.

The visible light sensor 1720 may be a color image sensor configured to identify red, green, and blue (RGB) of light, or may be a grayscale image sensor configured to identify only the brightness of light.

The visible light sensor 1720 may be a general camera (e.g., an RGB camera) configured to detect visible light to generate a color image (e.g., an RGB image). For example, the visible light sensor 1720 may be a general image sensor (e.g., a CCD sensor or a CMOS sensor) including an infrared light blocking filter. The visible light sensor 1720 may be oriented in a direction for capturing an image of a region including a surface to be cleaned in front of the path of the robot main body, and may be configured to capture an image of a travel region in front of the robot main body. In addition, an image captured by the visible light sensor 1720 may be a grayscale image or a black-and-white image rather than a color image.

The light emission unit 1800, the infrared light sensor 1710, and the visible light sensor 1720 may be provided in the cleaning robot 1000 to face a detection region of a surface to be cleaned.

The traveling module 1200 may move the cleaning robot 1000. The traveling module 1200 is driven according to a control signal set by the processor 1100. The processor 1100 sets a travel path, generates a control signal to cause the cleaning robot 1000 to move according to the travel path, and outputs the control signal to the traveling module 1200. The traveling module 1200 may include a motor that rotates wheels of the cleaning robot 1000, a timing belt installed to transmit power generated from a rear wheel to a front wheel, and the like.

The cleaning module 1900 may clean a surface to be cleaned. The cleaning module 1900 may include a dry-cleaning module (not shown) configured to suck in dust and trash, and a wet-cleaning module (not shown) configured to wipe a surface to be cleaned with a wet mop. The dry-cleaning module may include a brush, a brush motor, a dust container, a dust separator, a suction motor, and the like. The wet-cleaning module may include a mop pad, a mop pad motor, a mop pad up-down device module, a water container, a water supply motor, and the like.

The processor 1100 may control the light emission unit 1800 to emit infrared light toward the detection region on the surface to be cleaned in front of the cleaning robot 1000.

According to an embodiment of the present disclosure, the processor 1100 may control the light emission unit 1800 to emit light having, as a peak wavelength, an absorption wavelength that is determined based on the light absorption characteristics of water, toward the detection region.

In addition, the processor 1100 may receive infrared light reflected from the detection region, through the infrared light sensor 1710. In addition, the processor 1100 may receive visible light reflected from the detection region, through the visible light sensor 1720.

In addition, the processor 1100 may determine whether a liquid object is present in the detection region, based on the visible light and the intensity of the received infrared light.

According to an embodiment of the present disclosure, the processor 1100 may calculate the reflectance of the infrared light emitted toward the detection region, based on the intensity of the received infrared light. Based on the visible light and whether the calculated reflectance is greater than or equal to a threshold reflectance, the processor 1100 may determine whether a liquid object is present in the detection region in front.

Based on determining that a liquid object is present in the detection region in front, the processor 1100 may control the traveling module 1200 to move the cleaning robot 1000 to avoid the liquid object.

In addition, the processor 1100 may control the cleaning module 1900 to clean the surface to be cleaned.

Figure 3A:
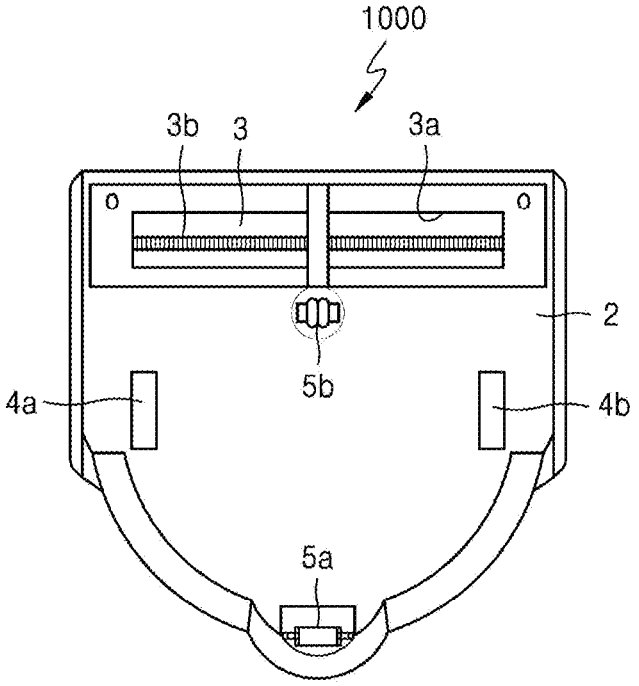
FIG. 3A illustrates a lower surface of a cleaning robot according to an embodiment of the present disclosure.

FIG. 3A illustrates a lower surface of the cleaning robot 1000 according to an embodiment of the present disclosure.

Referring to FIG. 3A, the cleaning robot 1000 may include the robot main body 2 having a flat box-shaped exterior. A suction unit 3 may be provided on a lower surface of a front end of the robot main body 2. The suction unit 3 may include a suction port 3*a* elongated in a horizontal direction. In addition, a brush 3*b* that rotates around an axis between both sides of the suction port 3*a* may be provided inside the suction port 3*a*.

Although not illustrated, the robot main body 2 may have a built-in suction motor, dust container, brush motor, and the like, and when in operation, the cleaning robot 1000 may drive the brush motor to scrape dust on the surface to be cleaned with the brush 3*b* while driving the suction motor to suck dust into the dust container through the suction port 3*a*. According to an embodiment of the present disclosure, in addition to the suction port 3*a* and the brush 3*b*, the cleaning robot 1000 may also include a mop module configured to perform a mopping function.

A pair of driving wheels 4*a* and 4*b* may be installed on left and right sides of the lower surface of the robot main body 2. Driven wheels 5*a* and 5*b* are installed at upper and lower center portions of the lower surface of the robot main body 2. Each of the driving wheel 4*a* and 4*b* may be configured to move forward and backward independently under control of driving of motors in the cleaning robot 1000. The traveling module 1200 may include a pair of driving wheels 4*a* and 4*b* or driven wheels 5*a* and 5*b*, and may move the cleaning robot 1000 on the surface to be cleaned. Accordingly, the cleaning robot 1000 may advance, retreat, turn left or right, and may freely travel on the surface to be cleaned. The cleaning robot 1000 may travel forward, which is a basic travel operation. In addition, the cleaning robot 1000 may retreat when avoiding an obstacle.

Figure 3B:
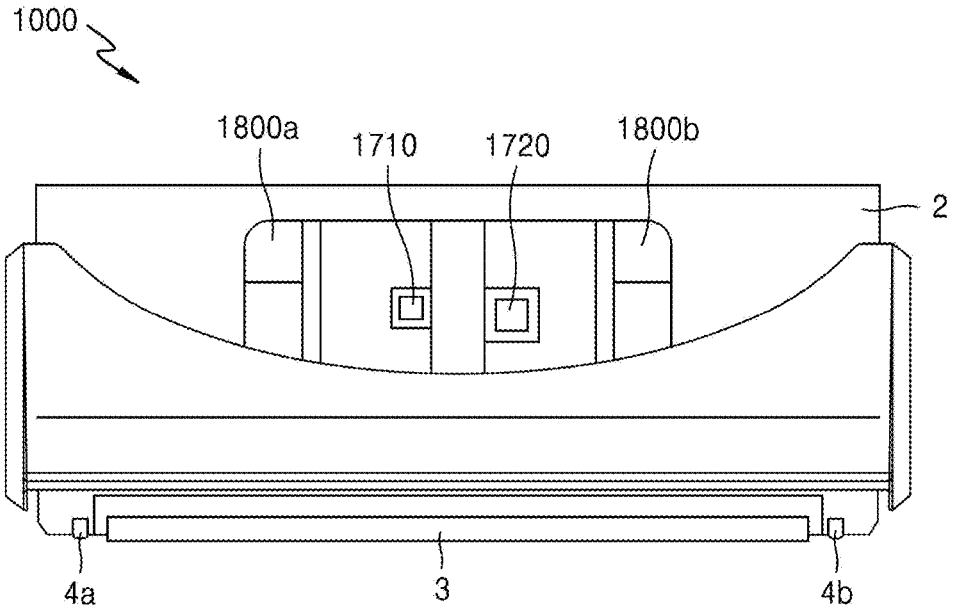
FIG. 3B illustrates a front surface of a cleaning robot according to an embodiment of the present disclosure.

FIG. 3B illustrates a front surface of the cleaning robot 1000 according to an embodiment of the present disclosure.

The light emission unit 1800 may include the pair of light sources 1800*a* and 1800*b*. The light sources 1800*a* and 1800*b* may be arranged at an interval in a horizontal direction.

Although not illustrated in FIG. 3B, the light emission unit 1800 may include only one light source. In addition, the light emission unit 1800 may include three or more light sources.

The light source (1800*a* or 1800*b*) of the light emission unit 1800 may be provided to emit infrared light obliquely toward a lower portion in front of the cleaning robot 1000. Thus, the light source (1800*a* or 1800*b*) may obliquely emit infrared light to spread radially below the front of the cleaning robot 1000. Accordingly, a surface to be cleaned (including a detection region to be described below) in front of the path of the cleaning robot 1000 may be illuminated approximately uniformly by the infrared light.

The infrared light sensor 1710 may be also oriented in a direction for capturing an image of the surface to be cleaned in front of the path of the robot main body 2, and thus may capture an image of a travel region in front of the robot main body 2.

According to an embodiment of the present disclosure, the infrared light sensor 1710 may be driven for TOF to measure the distance between an obstacle and the robot main body 2, in addition to detecting a liquid object. For example, the cleaning robot 1000 may calculate a round-trip time during which infrared light output from the light emission unit 1800 is reflected by an obstacle and then returns, based on a time point at which the infrared light is output from the light emission unit 1800 and a time point at which the output infrared light is reflected by the obstacle and then received through the infrared light sensor 1710. In addition, the cleaning robot 1000 may calculate the distance between the obstacle and the robot main body 2 based on the calculated round-trip time.

Accordingly, the cleaning robot 1000 may detect the presence or absence of a liquid object on the surface to be cleaned in front of the travel path by using a single infrared light sensor 1710, and determine the distance between an obstacle and the robot main body 2. In addition, the cleaning robot 1000, which has a function of measuring the distance between an obstacle and the robot main body 2, may be equipped with a function of detecting a liquid object by updating only a software program, even without a separate infrared light sensor 1710 added thereto.

The visible light sensor 1720 may be a general camera (e.g., an RGB camera) configured to detect visible light to capture a color image (e.g., an RGB image). The visible light sensor 1720 may be oriented in a direction for broadly capturing a travel region including a surface to be cleaned (including a detection region) in front of the travel path of the robot main body 2, and may be provided to capture an image of the travel region during travelling. In addition, an image captured by the visible light sensor 1720 may be a grayscale image or a black-and-white image rather than a color image.

The visible light sensor 1720 and the infrared light sensor 1710 may be installed to be separated from each other. An installation interval between the visible light sensor 1720 and the infrared light sensor 1710 is not limited to a particular value, but the visible light sensor 1720 and the infrared light sensor 1710 may be provided such that their image capture regions include the same detection region.

In addition, the visible light sensor 1720 and the infrared light sensor 1710 may be provided in the cleaning robot 1000 as one infrared-RGB (IR-RGB) camera.

Figure 4:
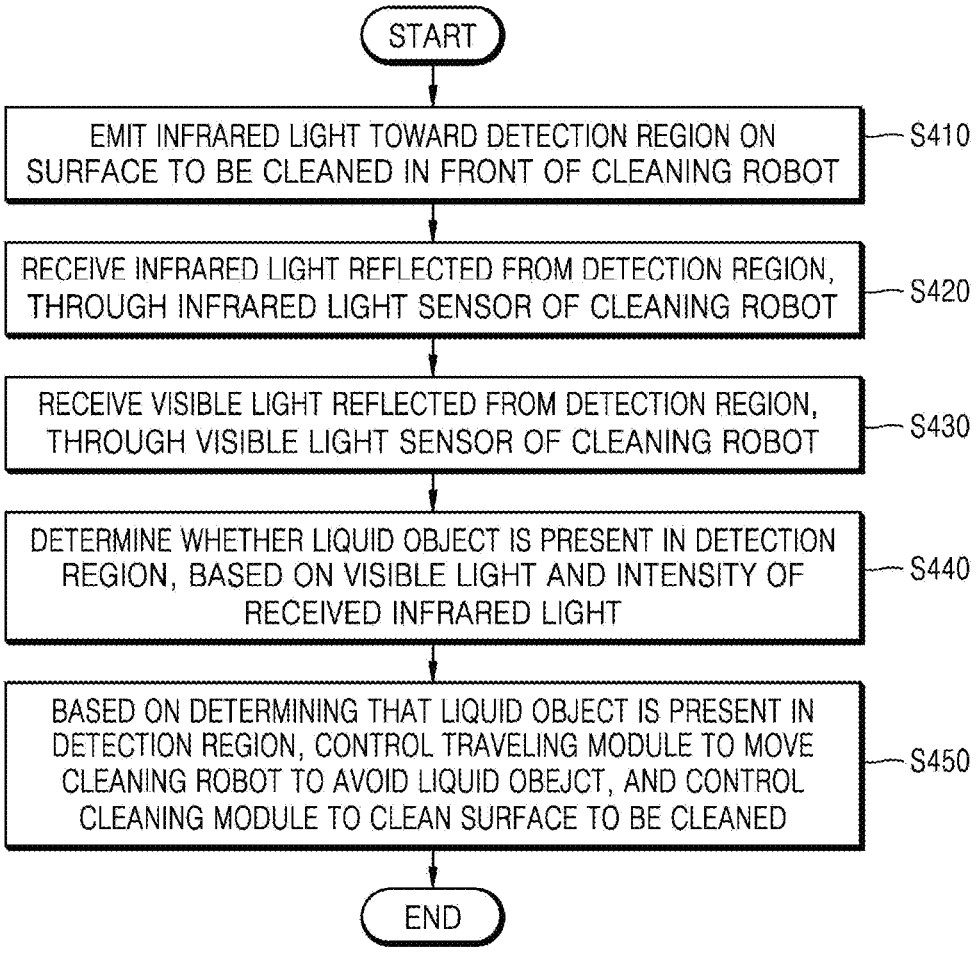
FIG. 4 is a flowchart of a method, performed by a cleaning robot, of avoiding a liquid object, according to an embodiment of the present disclosure.

FIG. 4 is a flowchart of a method, performed by the cleaning robot 1000, of avoiding a liquid object, according to an embodiment of the present disclosure.

In operation S410, the cleaning robot 1000 may emit infrared light toward a detection region on a surface to be cleaned in front of the cleaning robot.

According to an embodiment of the present disclosure, the cleaning robot 1000 may determine the presence or absence of a liquid object by using the characteristic that, when the angle of incidence of infrared light is greater than or equal to a threshold angle, the reflectance of the surface of the liquid object is high. In this case, the cleaning robot 1000 may control the light emission unit provided such that the angle of incidence of light is greater than or equal to the threshold angle, to emit infrared light toward the detection region.

According to an embodiment of the present disclosure, the cleaning robot 1000 may determine the presence or absence of a liquid object by using the characteristic that, when infrared light with a particular wavelength is emitted toward water, the absorption rate of the infrared light is high. In this case, the cleaning robot 1000 may emit infrared light having, as a peak wavelength, an absorption wavelength that is determined based on the light absorption characteristics of water, toward the detection region of the surface to be cleaned in front of the cleaning robot 1000.

In operation S420, the cleaning robot 1000 may receive infrared light reflected from the detection region, through the infrared light sensor of the cleaning robot 1000.

The infrared light sensor may be installed in the cleaning robot 1000 at a position and an angle for photographing the detection region.

In operation S430, the cleaning robot 1000 may receive visible light reflected from the detection region, through the visible light sensor of the cleaning robot 1000.

The visible light sensor may also be provided in the cleaning robot 1000 at a position and an angle for photographing the detection region.

The cleaning robot 1000 may control the infrared light sensor and the visible light sensor to photograph the detection region almost simultaneously. In addition, the cleaning robot 1000 may store received visible light data and infrared light data as a pair of pieces of data.

In operation S440, the cleaning robot 1000 may determine whether a liquid object is present in the detection region, based on the visible light and the intensity of the received infrared light.

The cleaning robot 1000 may generate an infrared light image representing the detection region based on the intensity of the received infrared light.

When the infrared light is emitted to the liquid object at an angle of incidence greater than a threshold angle, the liquid object may appear dark in the captured infrared light image of the detection region. In addition, when the infrared light having the absorption wavelength as a peak wavelength is emitted toward the liquid object, the liquid object may also appear dark in the captured infrared light image of the detection region. Accordingly, the cleaning robot 1000 may determine a region in the infrared light image of which a brightness value is less than or equal to a reference brightness, as a region in which the liquid object is placed.

The cleaning robot 1000 may generate a visible light image representing the detection region based on the received visible light.

The cleaning robot 1000 may more accurately determine whether a liquid object is present in the detection region, based on the infrared light image and the visible light image.

For example, when a region of which the brightness value is less than or equal to a first reference brightness is present in the infrared light image, and a corresponding region in the visible light image has a brightness value that is greater than or equal to a second reference brightness, the cleaning robot 1000 may determine that a liquid object is present in the region of which the brightness value is less than or equal to the first reference brightness.

In addition, for example, the cleaning robot 1000 may input the infrared light image and the visible light image to a machine learning model as input, and determine whether a liquid object is present in the detection region, based on an output of the machine learning model.

In operation S450, based on determining that a liquid object is present in the detection region, the cleaning robot 1000 may control the traveling module to move the cleaning robot to avoid the liquid object, and control the cleaning module to clean the surface to be cleaned.

Based on detecting a liquid object in the detection region while moving along the travel path, the cleaning robot 1000 may change the direction of the robot main body 2 or retreat.

In addition, when no liquid is detected in the detection region, the cleaning robot 1000 may travel along the set travel path without avoiding the detection region.

Figure 5:
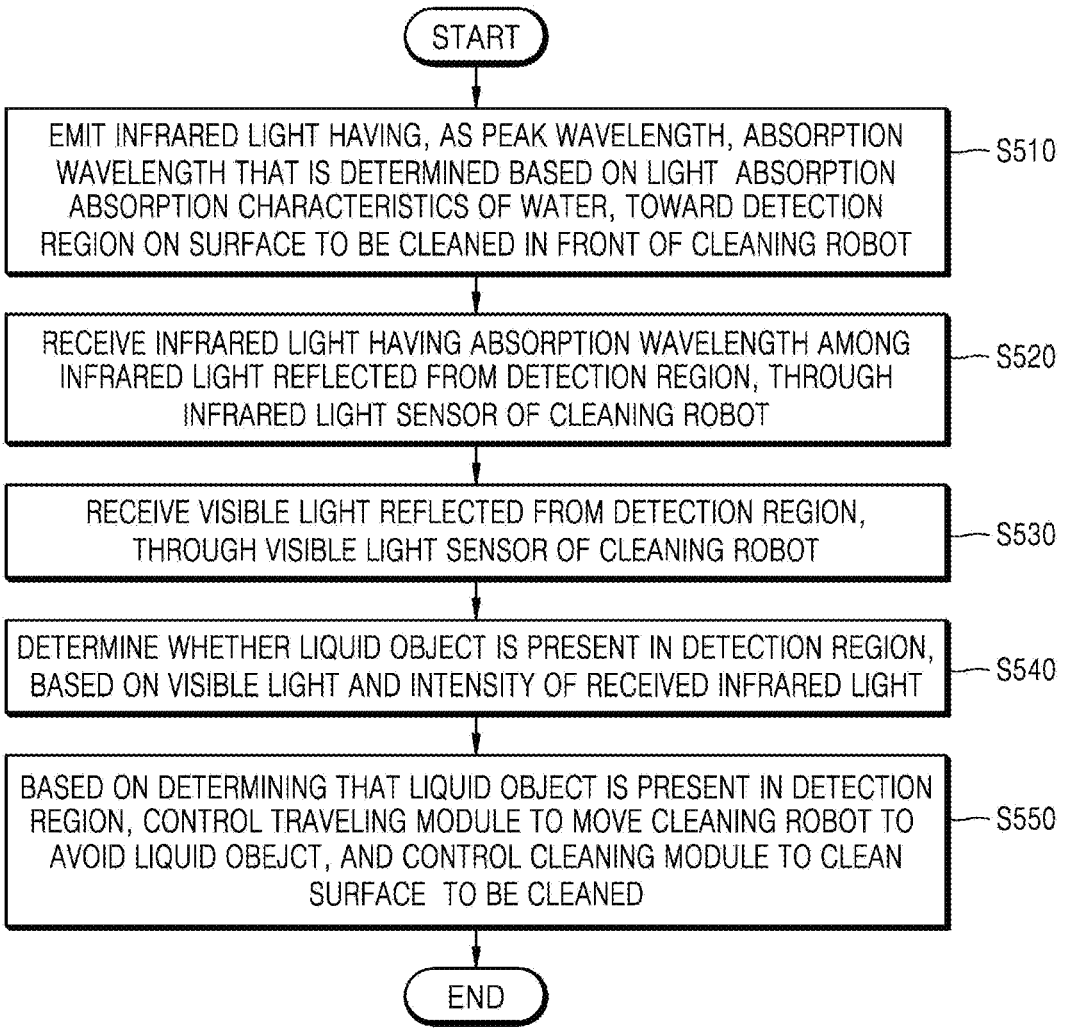
FIG. 5 is a flowchart of a method, performed by a cleaning robot, of avoiding a liquid object based on the light absorption characteristics of water, according to an embodiment of the present disclosure.

FIG. 5 is a flowchart of a method, performed by the cleaning robot 1000, of avoiding a liquid object based on the light absorption characteristics of water, according to an embodiment of the present disclosure.

In operation S510, the cleaning robot 1000 may emit infrared light having, as a peak wavelength, an absorption wavelength that is determined based on the light absorption characteristics of water, toward a detection region on a surface to be cleaned in front of the cleaning robot 1000.

The absorption wavelength may range between 930 nm and 1030 nm. The absorption wavelength may refer to a wavelength that has a higher light absorption rate than adjacent wavelengths according to the light absorption characteristics of water. In addition, according to an embodiment of the present disclosure, the absorption wavelength may be determined within the range of a near-infrared region.

The cleaning robot 1000 may control a light emission unit to emit light having the absorption wavelength as a peak wavelength. According to an embodiment of the present disclosure, the cleaning robot 1000 may emit light in a near-infrared region having the absorption wavelength as a peak wavelength.

In operation S520, the cleaning robot 1000 may receive infrared light having the absorption wavelength among infrared light reflected from the detection region, through the infrared light sensor of the cleaning robot 1000.

The infrared light sensor may include a band-pass filter for blocking visible light and receiving light having the absorption wavelength.

In operation S530, the cleaning robot 1000 may receive visible light reflected from the detection region, through the visible light sensor of the cleaning robot 1000.

According to an embodiment of the present disclosure, operation S520 and operation S530 may be performed almost simultaneously. For example, while traveling, the cleaning robot 1000 may control the infrared light sensor and the visible light sensor together to receive infrared light through the infrared light sensor and receive visible light through the visible light sensor, among light reflected from the same region of the surface to be cleaned.

In operation S540, the cleaning robot 1000 may determine whether a liquid object is present in the detection region, based on the visible light and the intensity of the received infrared light.

The cleaning robot 1000 may determine whether a liquid object is present in a region photographed by the infrared light sensor and the visible light sensor.

According to an embodiment of the present disclosure, the cleaning robot 1000 may generate an infrared light image corresponding to the intensity of the received infrared light. In addition, the cleaning robot 1000 may generate a visible light image corresponding to the intensity of the received visible light. In addition, the cleaning robot 1000 may determine whether a liquid object is present on the surface to be cleaned, based on the infrared light image and the visible light image.

According to an embodiment of the present disclosure, the cleaning robot 1000 may identify whether a liquid object is present on the photographed surface to be cleaned, based on a region of a liquid object in the visible light image or the infrared light image that is output from a machine learning model upon the infrared light image and the visible light image being input to the machine learning model as input.

According to an embodiment of the present disclosure, the cleaning robot 1000 may generate a synthetic image by combining the infrared light image with the visible light image, and identify whether a liquid object is present on the photographed surface to be cleaned, based on a region of a liquid object in the visible light image that is output from a machine learning model upon the synthetic image being input to the machine learning model as input.

According to an embodiment of the present disclosure, the cleaning robot 1000 may identify whether a liquid object is present on the photographed surface to be cleaned, based on a region of a liquid object in the infrared light image that is output from a first machine learning model upon the infrared light image being input to a first machine learning model as input, and a region of a liquid object in the visible light image that is output from a second machine learning model upon the visible light image being input to a second machine learning model as input.

According to an embodiment of the present disclosure, the cleaning robot 1000 may determine whether a liquid object is present on the photographed surface to be cleaned, based on a difference image between the infrared light image and the visible light image.

In operation S550, based on determining that a liquid object is present in the detection region, the cleaning robot 1000 may control the traveling module to move the cleaning robot 1000 to avoid the liquid object, and control the cleaning module to clean the surface to be cleaned.

According to an embodiment of the present disclosure, based on determining that a liquid object is present on the surface to be cleaned in front, the cleaning robot 1000 may determine a position of the cleaning robot 1000 on a map of the photographed region of the surface to be cleaned, based on a position of the cleaning robot 1000 on a map representing a region to be cleaned, change the travel path to avoid the liquid object based on the position on the map of the photographed region, and move the cleaning robot 1000 along the changed travel path.

According to an embodiment of the present disclosure, based on determining that a liquid object is present on the surface to be cleaned in front, the cleaning robot 1000 may determine a position of the liquid object on a map based on the position of the liquid object in the visible light image or the synthetic image and the position of the cleaning robot 1000 on the map, change the travel path to avoid the liquid object based on the determined position of the liquid object on the map, and move the cleaning robot 1000 along the changed travel path.

According to an embodiment of the present disclosure, based on determining that a liquid object is present on the surface to be cleaned in front, the cleaning robot 1000 may determine a relative position of the liquid object with respect to the cleaning robot 1000 based on the position of the liquid object in the visible light image or the synthetic image, and move the cleaning robot 1000 to avoid the liquid object based on the determined relative position.

According to an embodiment of the present disclosure, based on determining that a liquid object is present on the surface to be cleaned in front, the cleaning robot 1000 may output a notification that the liquid object is present on the surface to be cleaned in front.

According to an embodiment of the present disclosure, based on determining that a liquid object is present on the surface to be cleaned in front, the cleaning robot 1000 may transmit a notification that the liquid object is present on the surface to be cleaned in front, to a user device through a server.

According to an embodiment of the present disclosure, based on detecting a liquid object on the surface to be cleaned on the travel path while moving along the travel path, the cleaning robot 1000 may change the travel path to avoid the liquid object.

Based on detecting a liquid object on the surface to be cleaned on the travel path while moving along the travel path, the cleaning robot 1000 may change the direction of the robot main body 2 or retreat.

Figure 6A:
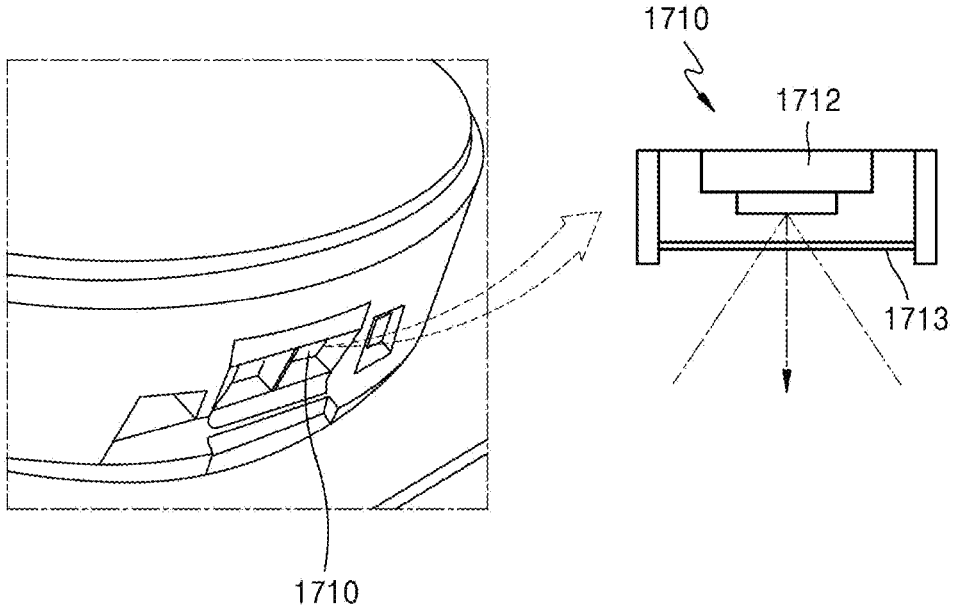
FIG. 6A illustrates an infrared light sensor of a cleaning robot configured to receive infrared light with an absorption wavelength, according to an embodiment of the present disclosure.

FIG. 6A illustrates the infrared light sensor 1710 of the cleaning robot 1000 configured to receive infrared light with an absorption wavelength, according to an embodiment of the present disclosure.

Referring to FIG. 6A, the infrared light sensor 1710 may include a camera 1712 capable of detecting visible light and near-infrared light, and a band-pass filter 1713 that blocks visible light and transmits light including infrared light with an absorption wavelength.

The infrared light sensor 1710 is a sensor for detecting a liquid object, and may be configured based on the light absorption characteristics of water.

The absorption wavelength is a wavelength in a region in which light absorption by water is highest, among regions below 1100 nm that may be detected by a Si semiconductor device in a general visible light camera. According to an embodiment of the present disclosure, the cleaning robot 1000 may use light around 970 nm.

Here, cameras for detecting visible light may generally be equipped with an optical filter that blocks infrared light, but the camera 1712 in FIG. 6A is a camera that does not have an optical filter or that has an optical filter separated therefrom.

Figure 6B:
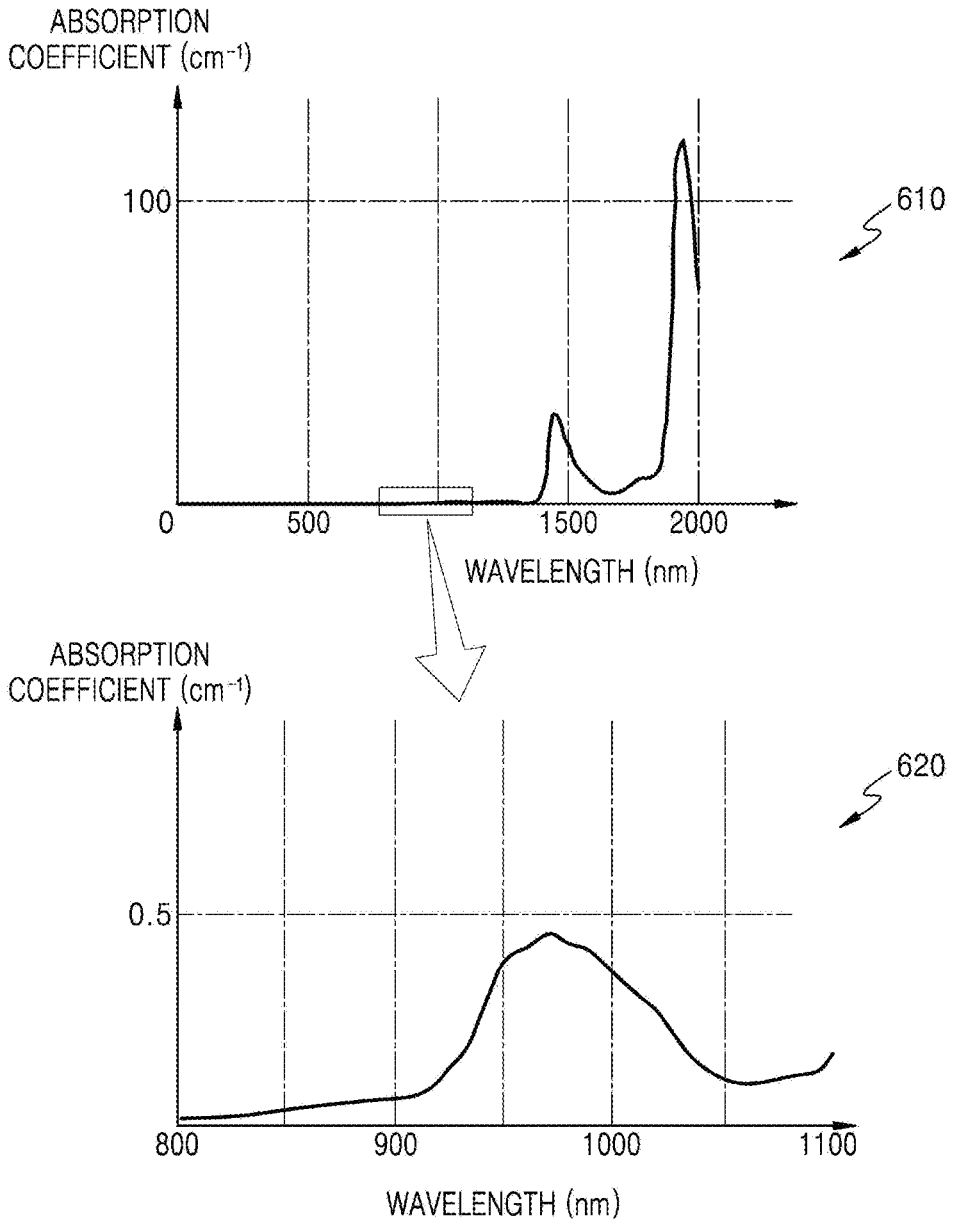
FIG. 6B shows light absorption spectra of water, according to an embodiment of the present disclosure.

FIG. 6B shows light absorption spectra of water, according to an embodiment of the present disclosure.

Referring to the light absorption spectra of water shown in FIG. 6B, as shown in an upper diagram 610 of FIG. 6B, water has a high peak at a wavelength of 1940 nm or 1450 nm. However, inexpensive Si semiconductors cannot detect, due to its principle, light in such a wavelength range, and an expensive device such as InGaAs is required to detect light in the wavelength range but is difficult to be installed in a home appliance in terms of cost.

On the contrary, even Si semiconductor devices used in general visible light cameras are able to detect light in a near-infrared region with a wavelength of up to about 1100 nm.

As shown in a lower enlarged diagram 620 of FIG. 6B, although lower than light absorption in an infrared region, light absorption by water occurs in a range between about 930 nm and about 1030 nm, and a peak is at about 970 nm.

Accordingly, according to an embodiment of the present disclosure, the cleaning robot 1000 may use a wavelength of 970 nm as an absorption wavelength. That is, the band-pass filter 1713 of FIG. 5 may be adopted to transmit infrared light with a wavelength of 970 nm, and the infrared light transmitted through the band-pass filter 1713 may be received by the camera 1712 that is a general visible light camera. Thus, the infrared light sensor 1710 may be implemented by combining the general visible light camera 1712 and the band-pass filter 1713 without using an expensive infrared light sensor.

As a result, even the inexpensive cleaning robot 1000 may detect a liquid object by using the light absorption characteristics of water. In addition, the absorption wavelength is preferably 970 nm, which is a peak of absorption, but may be selected within a range between 930 nm and 1030 nm, which exhibits relatively high absorption.

As described above, the infrared light sensor 1710 captures an image of a region including a surface to be cleaned in front of a travel path of the robot main body 2. Accordingly, among infrared light emitted by the light emission unit 1800, only infrared light with the absorption wavelength is detected and an image based on the infrared light with the absorption wavelength is captured. Because the infrared light is absorbed by water in a water-containing region, a region corresponding to the water region in the captured image may appear relatively dark. Accordingly, the cleaning robot 1000 may detect a liquid object.

Accordingly, the cleaning robot 1000 may be implemented inexpensively by using, as an infrared light sensor, a general camera having inferior sensitivity to that of the visible range but capable of detecting up to about 1100 nm in principle.

Figure 7:
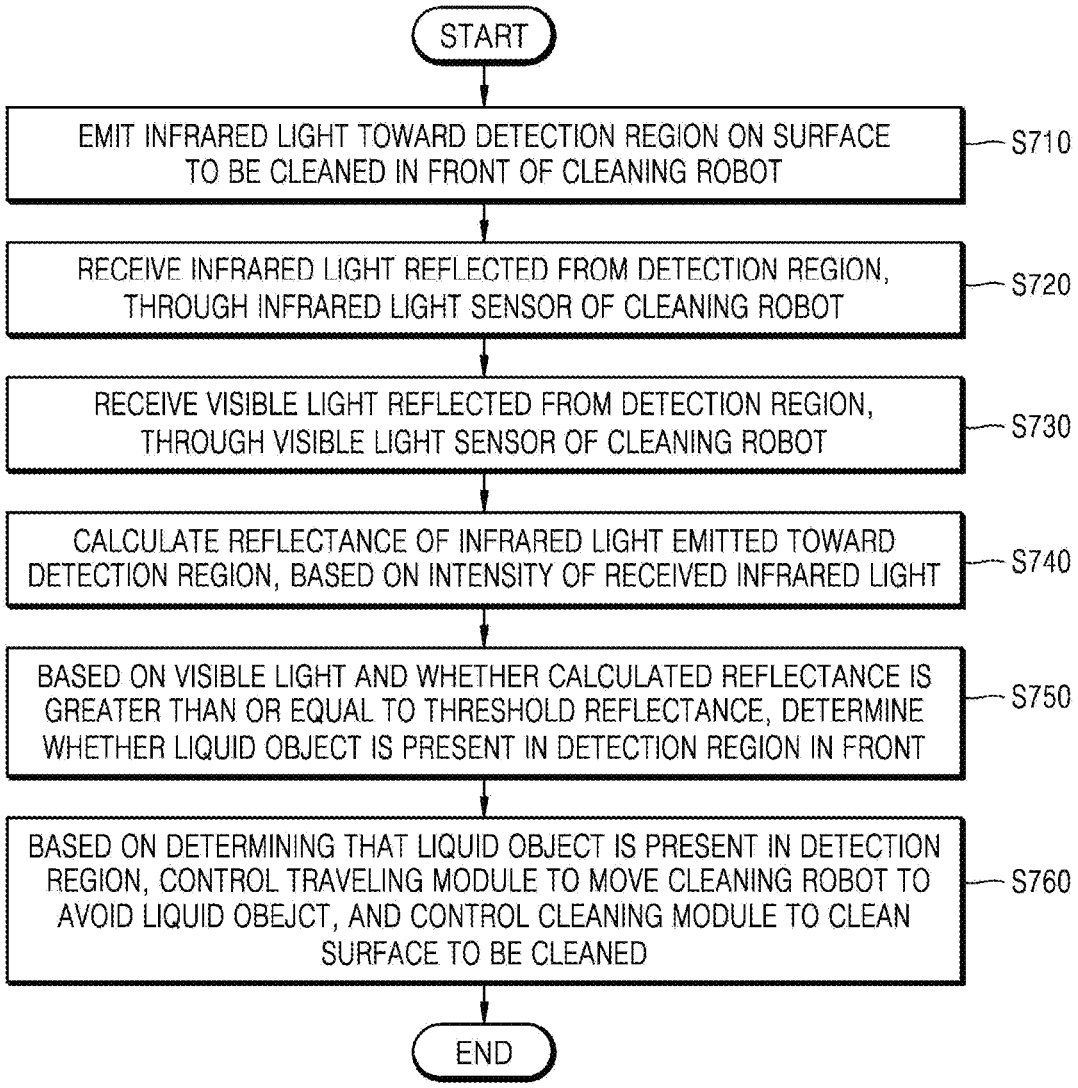
FIG. 7 is a flowchart of a method, performed by a cleaning robot, of avoiding a liquid object based on a reflectance according to an angle of incidence, according to an embodiment of the present disclosure.

FIG. 7 is a flowchart of a method, performed by the cleaning robot 1000, of avoiding a liquid object based on a reflectance according to an angle of incidence, according to an embodiment of the present disclosure.

In operation S710, the cleaning robot 1000 may emit infrared light toward a detection region on a surface to be cleaned in front of the cleaning robot.

The detection region is a region that is at a predetermined distance from the cleaning robot 1000, and is preset. In addition, angles and positions of a light source, a visible light sensor, and an infrared light sensor may be predetermined such that infrared light is emitted toward the detection region and the detection region is photographed.

According to an embodiment of the present disclosure, the cleaning robot 1000 may emit ultraviolet light rather than infrared light.

In operation S720, the cleaning robot 1000 may receive infrared light reflected from the detection region, through the infrared light sensor of the cleaning robot.

In operation S730, the cleaning robot 1000 may receive visible light reflected from the detection region, through the visible light sensor of the cleaning robot.

According to an embodiment of the present disclosure, operation S720 and operation S730 may be performed almost simultaneously. For example, the cleaning robot 1000 may control the infrared light sensor and the visible light sensor to photograph the detection region almost simultaneously. Among light reflected from the detection region, the cleaning robot 1000 may receive infrared light through the infrared light sensor, and may receive visible light through the visible light sensor.

In operation S740, the cleaning robot 1000 may calculate a reflectance of the infrared light emitted toward the detection region, based on the intensity of the received infrared light.

The cleaning robot 1000 may generate an infrared light image of the detection region based on the intensity of the received infrared light.

Among the transmitted infrared light, infrared light that is not received back by the infrared light sensor may be considered as reflected infrared light. Accordingly, the cleaning robot 1000 may calculate the reflectance of the infrared light emitted toward the detection region based on the intensity of the received infrared light relative to the intensity of the transmitted infrared light. For example, the cleaning robot 1000 may calculate the reflectance of the infrared light corresponding to each pixel constituting the infrared light image.

In operation S750, based on the visible light and whether the calculated reflectance is greater than or equal to a threshold reflectance, the cleaning robot 1000 may determine whether a liquid object is present in the detection region in front.

According to an embodiment of the present disclosure, the cleaning robot 1000 may determine that a liquid object is present in a region of the detection region of which the reflectance is greater than or equal to the threshold reflectance.

According to an embodiment of the present disclosure, when a region of which the reflectance is greater than or equal to the threshold reflectance (i.e., a region of which the brightness is less than or equal to a first reference brightness) is present in the detection region, and a corresponding region in the visible light image has a brightness greater than or equal to a second reference brightness, the cleaning robot 1000 may determine that a liquid object is present in the region of which the reflectance is greater than or equal to the threshold reflectance.

According to an embodiment of the present disclosure, the cleaning robot 1000 may generate an infrared light image based on the intensity of received infrared light, and generate a visible light image based on the received visible light.

The cleaning robot 1000 may input the infrared light image and the visible light image to a machine learning model as input, and determine whether a liquid object is present in the detection region, based on an output of the machine learning model.

In operation S760, based on determining that a liquid object is present in the detection region, the cleaning robot 1000 may control the traveling module to move the cleaning robot to avoid the liquid object, and control the cleaning module to clean the surface to be cleaned.

Figure 8A:
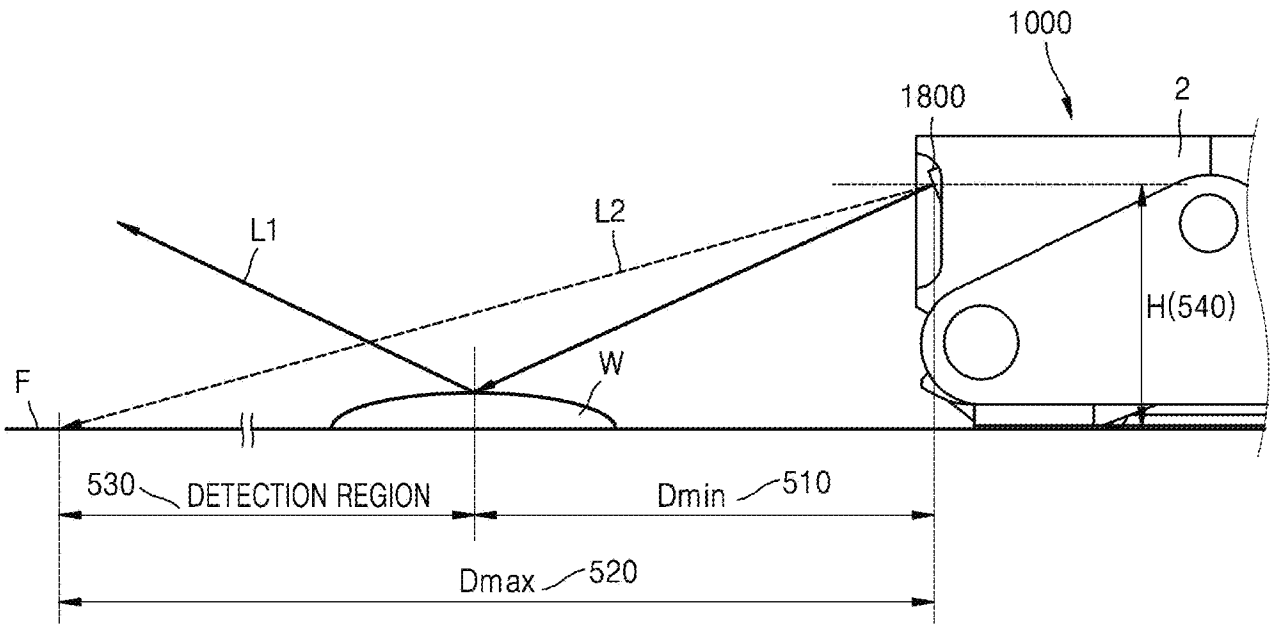
FIG. 8A illustrates a method, performed by a cleaning robot, of emitting infrared light toward a liquid object in a detection region, according to an embodiment of the present disclosure.

FIG. 8A illustrates a method, performed by the cleaning robot 1000, of emitting infrared light toward a liquid object in a detection region, according to an embodiment of the present disclosure.

Referring to FIG. 8A, the light emission unit 1800 may be installed at a height 540 at which the amount of reflection of emitted light on the surface of the liquid object W is greater than or equal to a reference proportion (e.g., 3%).

A detection region 530 (hereinafter, also referred to as a detection region) of the infrared light sensor 1710 is a region to be detected by the cleaning robot 1000, and refers to a region to be detected by the infrared light sensor 1710. The detection region 530 may be determined according to, for example, the attachment position of the infrared light sensor 1710, the angle of view of the infrared light sensor 1710, the range of the surface to be cleaned to which infrared light is emitted by the light emission unit 1800, and the like.

A shortest detection distance 510 of the infrared light sensor 1710 is the shortest distance in the detection region 530 when viewed from the front surface of the cleaning robot 1000. The shortest detection distance 510 may be determined based on the attachment position or angle of view of the infrared light sensor 1710, and the turning radius of the cleaning robot 1000, but is not limited thereto.

A longest detection distance 520 of the infrared light sensor 1710 may be, for example, the maximum distance between the cleaning robot 1000 and infrared light reflected from the surface F to be cleaned and then received by the infrared light sensor 1710. The detection region 530 may be a region between the shortest detection distance 510 and the longest detection distance 520.

Figure 8B:
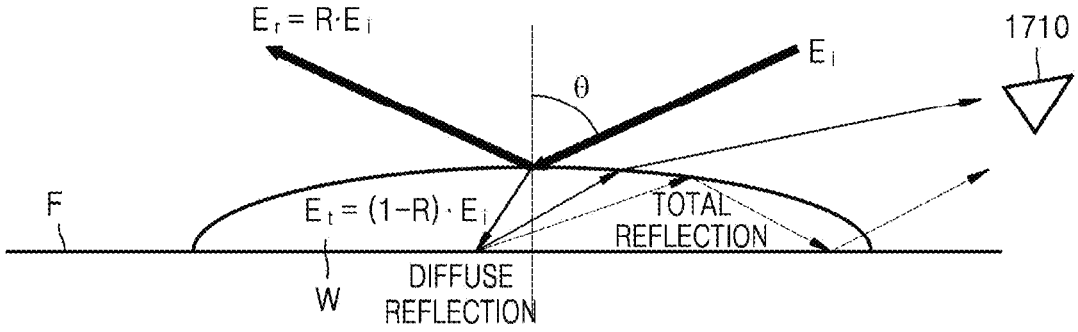
FIG. 8B illustrates a method, performed by a cleaning robot, of determining the presence or absence of a liquid object based on a reflectance of light, according to an embodiment of the present disclosure.

FIG. 8B illustrates a method, performed by the cleaning robot 1000, of determining the presence or absence of a liquid object based on a reflectance of light, according to an embodiment of the present disclosure.

Figure 9A:
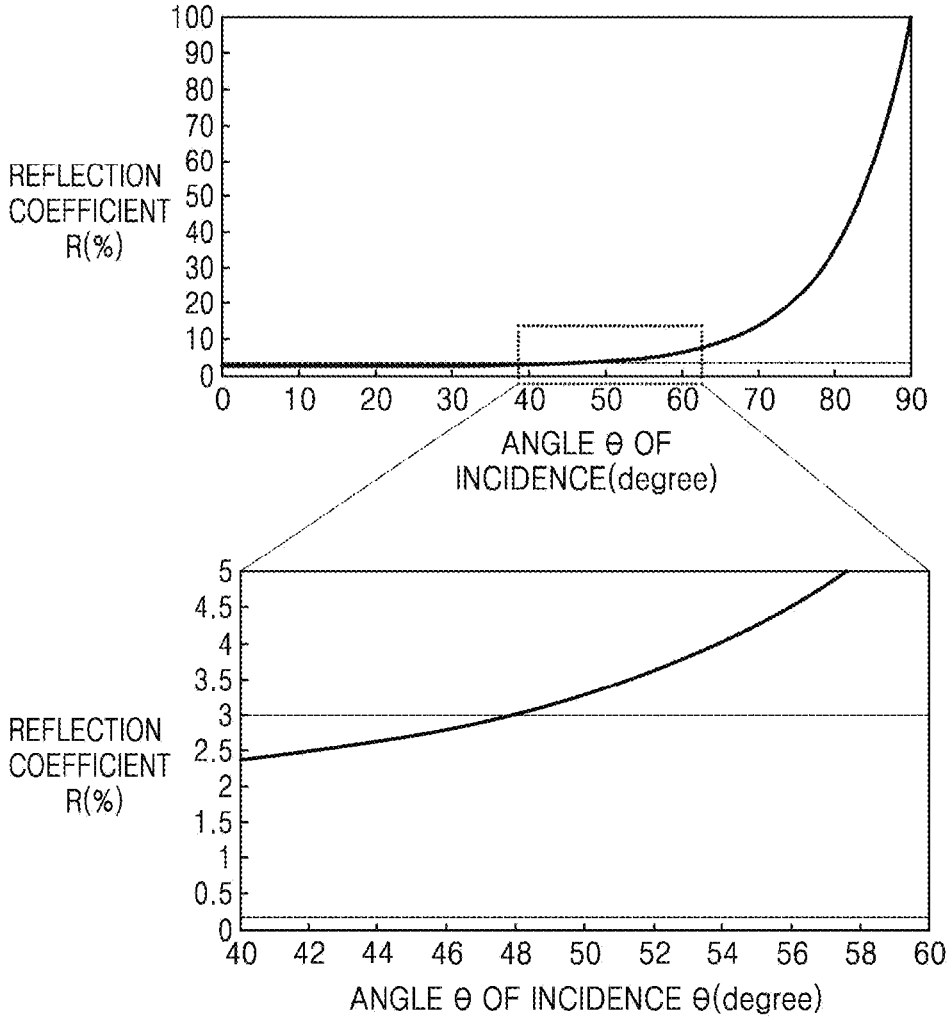
FIGS. 9A and 9B show the relationship between the angle of incidence of infrared light and the proportion of regular reflection, according to an embodiment of the present disclosure.
Figure 9B:
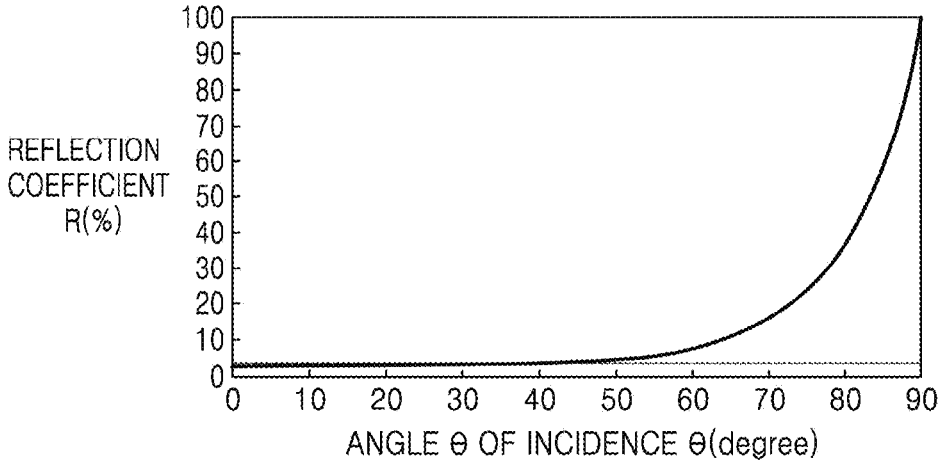

Referring to FIG. 8B, part $E_r$ of infrared light $E_i$ output from the light emission unit 1800 is regularly reflected from the surface of the liquid object W, and a remainder $E_t$ is transmitted into the liquid object. Here, as shown in FIGS. 9A and 9B, as an angle θ of incidence of the infrared light $E_i$ on the surface of the liquid object W increases, the proportion of regular reflection ($E_r$) on the surface of the liquid object W increases.

In addition, the transmitted infrared light $E_t$ is diffusely reflected and then received by the infrared light sensor 1710. In this case, part of the transmitted infrared light $E_t$ may be totally reflected.

As the angle θ of incidence of the infrared light $E_i$ on the surface of the liquid object W increases, the proportion of regular reflection ($E_r$) on the surface of the liquid object W increases, and thus, the proportion of the infrared light transmitted into the liquid object and then received by the infrared light sensor 1710 decreases.

A relationship between an incident component ($E_i$) and a reflection component ($E_r$) of infrared light at the boundary of the liquid object W is the following Equation (1).

$$Er = R \cdot Ei \qquad \text{Equation (1)}$$

In Equation (1), R denotes a reflectance.

The reflectance R may be calculated based on the following Equations (2) to (4).

$$Rp = \frac{\left|\left(\frac{n_2}{n_1}\right)^2 \cos\theta - \sqrt{\left(\frac{n_2}{n_1}\right)^2 - \sin^2\theta}\right|^2}{\left|\left(\frac{n_2}{n_1}\right)^2 \cos\theta + \sqrt{\left(\frac{n_2}{n_1}\right)^2 - \sin^2\theta}\right|^2} \qquad \text{Equation (2)}$$

$$Rs = \frac{\left|\cos\theta - \sqrt{\left(\frac{n_2}{n_1}\right)^2 - \sin^2\theta}\right|^2}{\left|\cos\theta + \sqrt{\left(\frac{n_2}{n_1}\right)^2 - \sin^2\theta}\right|^2} \qquad \text{Equation (3)}$$

$$R = \frac{(R_p + R_s)}{2} \qquad \text{Equation (4)}$$

In Equations (2) to (4), θ denotes an angle of incidence, $R_p$ denotes a p-polarized reflectance, $R_s$ denotes an s-polarized reflectance, n1 denotes the refractive index of air (=1), and n2 denotes the refractive index of liquid.

Here, the reflectance R also changes depending on polarization. For example, when an LED light source is used as a light source, polarization does not occur. From this background, the reflectance R may be the average of reflectances for two polarizations.

As may be seen from Equations (1) to (4) and FIGS. 9A and 9B, the reflectance of the surface of liquid with respect to infrared light incident at a high angle θ of incidence is high. Accordingly, as the angle of incidence on the surface of the liquid object W increases, the amount of infrared light transmitted through the liquid object W and then received by the infrared light sensor 1710 decreases, and thus, as the angle of incidence increases, the liquid object may appear darker than surrounding regions of the liquid object in an image captured by the infrared light sensor 1710.

Accordingly, as the angle θ of incidence increases, the difference between the amount of light received from the liquid object W and the amount of light received from an object other than the liquid object W increases, and thus, that the liquid object W may be detected more accurately. Thus, in order to minimize the influence of ambient light, it is preferable that the height of the light source from the surface to be cleaned be low.

FIGS. 9A and 9B show the relationship between the angle of incidence of infrared light and the proportion of regular reflection, according to an embodiment of the present disclosure.

Graphs of FIG. 9A show the proportion of regular reflection according to the angle of incidence when infrared light with a wavelength of 850 nm is emitted toward water.

Referring to the upper graph of FIG. 9A, it may be seen that, as the angle of incidence increases, a reflection coefficient R, which is the proportion of regular reflection, increases.

The lower graph of FIG. 9A is an enlarged graph showing the reflection coefficient R when the angle of incidence in the upper graph is 40° to 60°. It may be seen that, when the angle of incidence is 48° or greater, the reflection coefficient R is 3% or greater.

Graphs of FIG. 9B show the proportion of regular reflection according to the angle of incidence when infrared light with a wavelength of 850 nm is emitted toward oil. Similar to water, it may be seen that as the angle of incidence increases, the proportion of regular reflection increases.

The wavelength of infrared light emitted from the light emission unit 1800 is not limited to 850 nm, and the same effect may be obtained even when infrared light with other wavelengths is used. In addition, ultraviolet light may be used as a light source of the light emission unit 1800, rather than infrared light. However, in terms of manufacturing cost, infrared light may be more preferable.

A liquid object may include an organic compound such as alcohol, in addition to water or oil.

In general, the reflectance of liquid is determined by the refractive index of the liquid, and as the refractive index decreases, the reflectance also decreases. Because the refractive index of organic compounds such as alcohol is greater than that of water, the cleaning robot 1000 may also detect liquid such as organic compounds.

In addition, it was experimentally confirmed that, even when a solid substance is mixed in water, as in milk or juice, the ratio of the angle of incidence to regular reflection is not significantly different from the characteristics of water.

In addition, it was experimentally confirmed that, when the reflection amount of emitted light on the surface of a liquid object is at least 3%, the difference between the amount of light received from the liquid object W and the amount of light received from an object other than the liquid object W increases, and thus, the liquid object W and a general surface to be cleaned may be accurately distinguished from each other.

Thus, the cleaning robot 1000 includes a light source at a position of the cleaning robot 1000 where the amount of reflection of emitted light on the surface of a liquid object is at least 3%, and thus may detect various types of liquid present on a floor in a home.

In a case where only one light source is provided, the light source may be provided at a height of the cleaning robot 1000 such that the amount of reflection of emitted light on the surface of a liquid object is at least 3%. In addition, when two or more light sources are provided, at least one of them may be provided at a height of the cleaning robot 1000 such that the amount of reflection of emitted light on the surface of a liquid object is at least 3%. However, in a case where a plurality of light sources are installed spaced apart from each other in a horizontal direction in order to expand the viewing range of the cleaning robot 1000, it is preferable that the heights of the light sources be equal to each other.

Figure 10A:
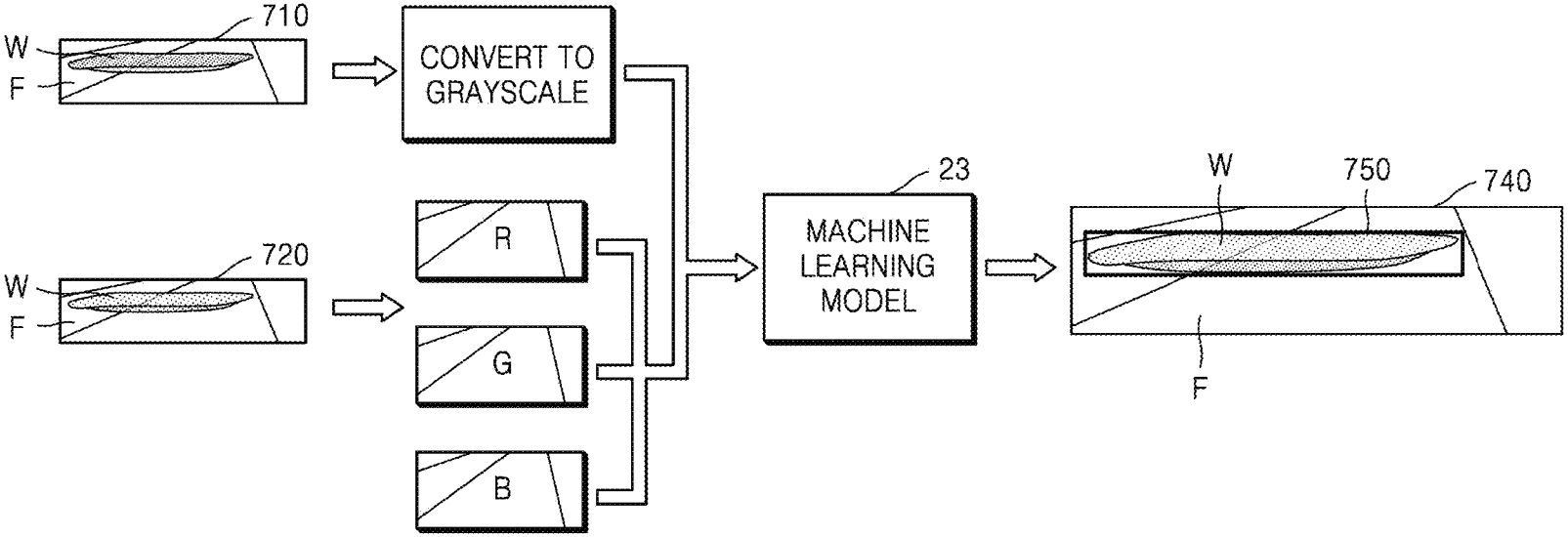
FIG. 10A illustrates a method, performed by a cleaning robot, of determining whether a liquid object is present on a surface to be cleaned, by using a machine learning model, according to an embodiment of the present disclosure.

FIG. 10A illustrates a method, performed by the cleaning robot 1000, of determining whether a liquid object W is present on a surface to be cleaned, by using a machine learning model, according to an embodiment of the present disclosure.

Referring to FIG. 10A, the cleaning robot 1000 may determine the presence or absence of the liquid object W by using a machine learning model.

Before determining the presence or absence of a liquid object based on an infrared light image 710 and a visible light image 720, the cleaning robot 1000 may determine whether the two images represent the same region at the same time point. The cleaning robot 1000 may match the infrared light image 710 with the visible light image 720 such that the infrared light image 710 and the visible light image 720 represent the same region at the same time point.

In the infrared light image 710, the liquid object W appears darker than surrounding regions of the liquid object W. In addition, when the liquid object W is transparent, it may be difficult to identify the liquid object W in the visible light image 720.

According to an embodiment of the present disclosure, the cleaning robot 1000 may generate a synthetic image by combining the infrared light image 710 with the visible light image 720, and obtain information about a liquid object from a machine learning model 23 by inputting (applying) the generated synthetic image to the machine learning model 23 that is trained for synthetic images.

An image in which a front edge of liquid is emphasized may be obtained by direct reflection of light hitting the edge of the liquid or by reflection within the liquid (total reflection of FIG. 8B). In this case, by combining the infrared light image 710 obtained from the infrared light sensor 1710 with the visible light image 720 obtained from the visible light sensor 1720, the influence of the shape, color, and shadow of the liquid may be suppressed, and thus, the accuracy of detection of liquid may be improved.

According to an embodiment of the present disclosure, the cleaning robot 1000 does not combine the infrared light image 710 with the visible light image 720, but may apply the infrared light image 710 and the visible light image 720 to the machine learning model 23 that is completely trained. For example, the positions of the respective images may be adjusted to change the images into data of height×width×4 channels (4 channels including an infrared light image, an R image, a G image, and a B image), and the changed 4-channel data may be input to the machine learning model 23 that is completely trained for 4-channel data.

According to an embodiment of the present disclosure, the cleaning robot 1000 may determine the presence or absence of a liquid object based on only the infrared light image 710. In this case, the cleaning robot 1000 includes the completely trained machine learning model 23 corresponding to the infrared light image 710, and may apply the infrared light image 710 to the machine learning model 23. In detail, the cleaning robot 1000 may input data of height×width×1 channel (an infrared light image) to the completely trained machine learning model 23.

According to an embodiment of the present disclosure, the cleaning robot 1000 may determine the presence or absence of a liquid object based on a plurality of infrared light images captured at consecutive time points and a plurality of visible light images captured at consecutive time points.

When an output of the machine learning model 23 represents a position of a region 750 of the liquid object W in a detection region image 740 of the surface F to be cleaned, and the region 750 of the liquid object W is larger than a predetermined size, the cleaning robot 1000 may determine that the liquid object W is present in the photographed detection region.

When the output of the machine learning model 23 represents a position of the liquid object W in the detection region image 740 of the surface F to be cleaned, the cleaning robot 1000 may determine the position of the liquid object W on a map of a cleaning region based on the current position of the cleaning robot 1000 on the map of the cleaning region and the position of the liquid object W in the detection region image 740. In addition, the cleaning robot 1000 may change (modify) a travel path based on the position of the liquid object W on the map.

According to an embodiment of the present disclosure, when the output of the machine learning model 23 indicates that the liquid object W is not detected in the detection region image 740, the cleaning robot 1000 may determine that the liquid object W is not present on the surface to be cleaned.

Figure 10B:
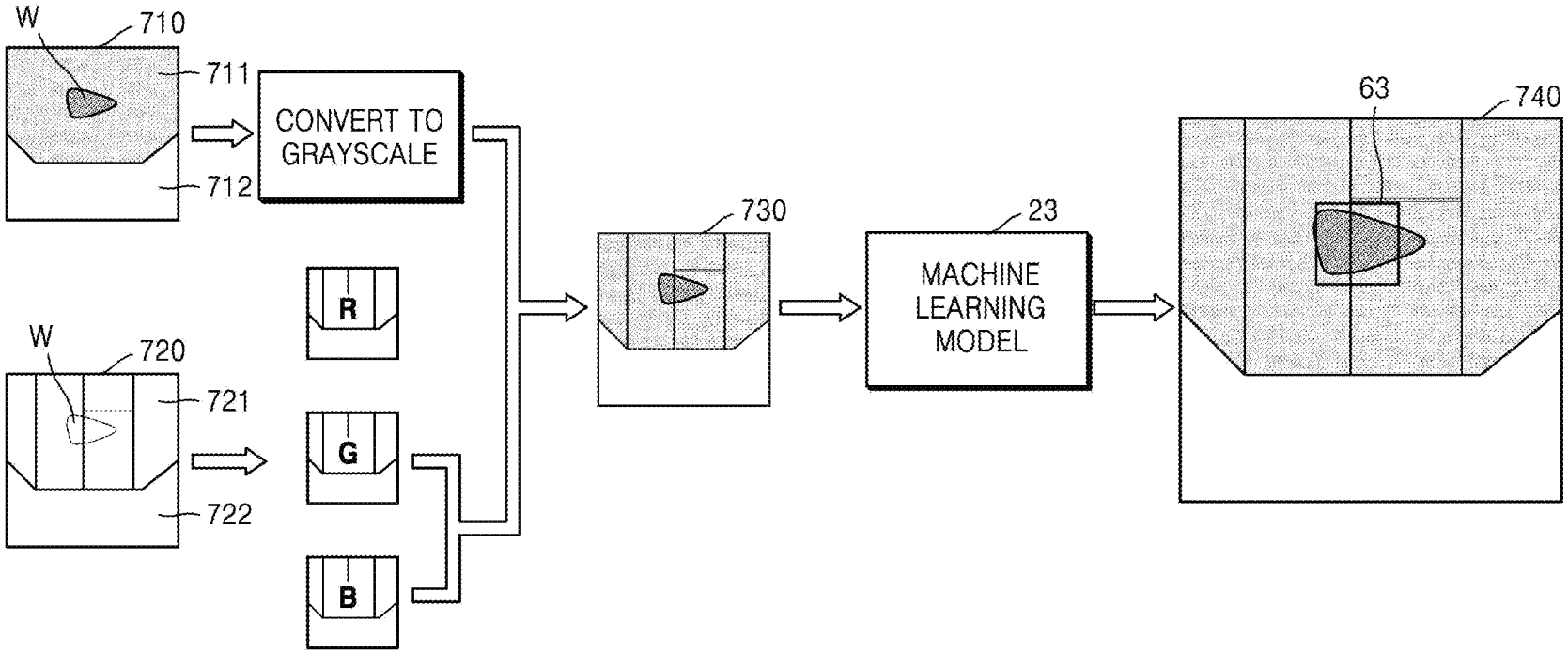
FIG. 10B illustrates a method, performed by a cleaning robot, of determining whether a liquid object is present on a surface to be cleaned, by using a machine learning model, according to an embodiment of the present disclosure.

FIG. 10B illustrates a method, performed by the cleaning robot 1000, of determining whether a liquid object W is present on a surface to be cleaned, by using a machine learning model, according to an embodiment of the present disclosure.

Referring to FIG. 10B, the cleaning robot 1000 may determine the presence or absence of the liquid object W by using a machine learning model.

According to an embodiment of the present disclosure, the cleaning robot 1000 may generate a synthetic image 730 by combining the infrared light image 710 with the visible light image 720. In addition, the cleaning robot 1000 may input the generated synthetic image 730 as input to a preset, completely trained machine learning model in order to determine the presence or absence of the liquid object W. The cleaning robot 1000 may determine the presence or absence of the liquid object W on a surface to be cleaned, and a region of the liquid object W on the surface to be cleaned, based on an output of the machine learning model.

On the left side of FIG. 10B, examples of the infrared light image 710 and the visible light image 720 are illustrated. The infrared light image 710 and the visible light image 720 may be images that include the same region of the surface to be cleaned. Lower portions 712 and 722 of the infrared light image 710 and the visible light image 720 are outside the imaging field of view, and upper portions 711 and 721 are within the imaging field of view. In the infrared light image 710, the liquid object W appears darker than surrounding regions of the liquid object W. In addition, when the liquid object W is transparent, it may be difficult to identify the liquid object W in the visible light image. The cleaning robot 1000 may generate the synthetic image 730 by combining the infrared light image 710 with the visible light image 720, and obtain information about a liquid object from the machine learning model 23 by inputting (applying) the generated synthetic image 730 to the machine learning model 23. For example, the cleaning robot 1000 may generate the synthetic image 730 by converting the infrared light image 710 to grayscale and substituting a G channel and a B channel among RGB channels of the visible light image 720 with the grayscale infrared light image.

In addition, for example, the cleaning robot 1000 may obtain a three-channel synthetic image in which the infrared light image and the visible light image are combined, by converting the infrared light image 710 to grayscale and substituting an image of the R channel among the RGB channels of the visible light image 720 with the grayscale infrared light image.

In addition, for example, the cleaning robot 1000 may generate a synthetic image by converting the infrared light image 710 to grayscale and substituting the G or B channel among the RGB channels of the visible light image 720 with the grayscale infrared light image.

In addition, for example, the cleaning robot 1000 may generate a synthetic image as a 4-channel image by using the infrared light image 710 as a transmittance. The method of combining the infrared light image 710 with the visible light image 720 is not limited to the above descriptions, and may be any method as long as it is a synthesis method for obtaining information about both the infrared light image 710 and the visible light image 720. The machine learning model of the cleaning robot 1000 may be trained by using training data before driving the cleaning robot 1000. The machine learning model may also be referred to as an artificial intelligence (AI) model or a neural network model.

The neural network model may include a plurality of neural network layers (e.g., an input layer, an intermediate layer (hidden layer), and an output layer). Each of the neural network layers has a plurality of weight values, and performs a neural network arithmetic operation via an arithmetic operation between an arithmetic operation result of a previous layer and the plurality of weight values. The plurality of weight values in each of the neural network layers may be optimized by a result of training the neural network model. For example, the plurality of weight values may be updated to reduce or minimize a loss or cost value obtained by the neural network model during a training process. Examples of neural networks include deep neural networks (DNNs), convolutional neural networks (CNNs), recurrent neural networks (RNNs), restricted Boltzmann machines (RBMs), deep belief networks (DBNs), bidirectional recurrent DNNs (BRDNNs), or deep Q-networks, but are not limited thereto.

The neural network model according to an embodiment of the present disclosure may be a model for inferring the position of a liquid object. Inference/prediction is a technique for determining information for logical inference and prediction, and includes knowledge/probability-based reasoning, optimization prediction, preference-based planning, recommendation, etc.

Functions related to AI according to the present disclosure are performed by at least one processor and a memory. The at least one processor may include one or more processors. In this case, the at least one processor may be a general-purpose processor, such as a central processing unit (CPU), an application processor (AP), or a digital signal processor (DSP), a dedicated graphics processor, such as a graphics processing unit (GPU) or a vision processing unit (VPU), or a dedicated artificial intelligence processor, such as a neural processing unit (NPU). The at least one processor performs control such that input data is processed according to predefined operation rules or an AI model (e.g., a neural network model) stored in the memory. Alternatively, in a case in which the at least one processor is a dedicated AI processor, the dedicated AI processor may be designed with a hardware structure specialized for processing a particular AI model.

The predefined operation rules or AI model (e.g., a neural network model) may be generated via a training process. Here, being generated via a training process may mean that predefined operation rules or AI model set to perform desired characteristics (or purposes), is generated by training a basic AI model by using a learning algorithm that utilizes a large amount of training data. The training process may be performed by a device itself (e.g., the cleaning robot 1000) on which artificial intelligence according to the present disclosure is performed, or by a separate server and/or system. Examples of learning algorithms may include, for example, supervised learning, unsupervised learning, semi-supervised learning, and reinforcement learning, but are not limited thereto.

The training data according to an embodiment of the present disclosure may be a synthetic image of a pair of an infrared light image and a visible light image obtained by photographing a liquid object (e.g., water or juice) spilled on a surface to be cleaned. In this case, the position of the liquid object may be labeled within the synthetic image corresponding to the pair of images. In addition, the training data may include a pair of an infrared light image and a visible light image of the surface to be cleaned on which no liquid object is present. In this case, information indicating that no liquid object is present may be labeled corresponding to the pair of images. In addition, the training data may include numerous pairs of infrared light images and visible light images for various types of liquid objects present on various types of surfaces to be cleaned.

According to an embodiment of the present disclosure, the machine learning model may be trained to, upon one synthetic image being input to the machine learning model, output a position of a liquid object labeled in the synthetic image (to infer the position of the liquid object). In addition, the machine learning model may be trained to, upon a synthetic image in which no liquid object is present being input to the machine learning model, output information indicating that no liquid object is present.

The cleaning robot 1000 may determine the presence or absence of the liquid object W and the position of the liquid object W by using the completely trained machine learning model 23. For example, while the cleaning robot 1000 is traveling, the cleaning robot 1000 may control the infrared light sensor 1710 and the visible light sensor 1720 to photograph the surface to be cleaned in front of a travel path. In addition, the cleaning robot 1000 may generate the synthetic image 730 by processing the infrared light image and the visible light image obtained from the infrared light sensor 1710 and the visible light sensor 1720, respectively. The cleaning robot 1000 determines the presence or absence of the liquid object W and the position of the liquid object W by applying the generated synthetic image 730 to the completely trained machine learning model 23 mounted thereon.

On the right side of FIG. 10B, an example of a determination result image (a detection region image, 740) representing a determination result by the completely trained machine learning model 23 is illustrated. When an output of the machine learning model 23 represents a position of the liquid object W in the synthetic image 730, the cleaning robot 1000 may generate the determination result image 740 in which the position of the liquid object W on the synthetic image 730 is marked with an edge 63.

According to an embodiment of the present disclosure, when the output of the machine learning model 23 represents a position of the liquid object W in the synthetic image 730, and the region of the liquid object W is larger than or equal to a predetermined size, the cleaning robot 1000 may determine that the liquid object W is present on the photographed surface to be cleaned.

According to an embodiment of the present disclosure, when the output of the machine learning model 23 represents the position of the liquid object W in the synthetic image 730, the cleaning robot 1000 may determine the position of the liquid object W on a map of a cleaning region based on the current position of the cleaning robot 1000 on the map of the cleaning region, and the position of the liquid object W in the synthetic image 730. In addition, the cleaning robot 1000 may change (modify) the travel path based on the position of the liquid object W on the map.

According to an embodiment of the present disclosure, when the output of the machine learning model 23 indicates that the liquid object W is not detected in the synthetic image 730, the cleaning robot 1000 may determine that the liquid object W is not present on the surface to be cleaned.

Figure 11A:
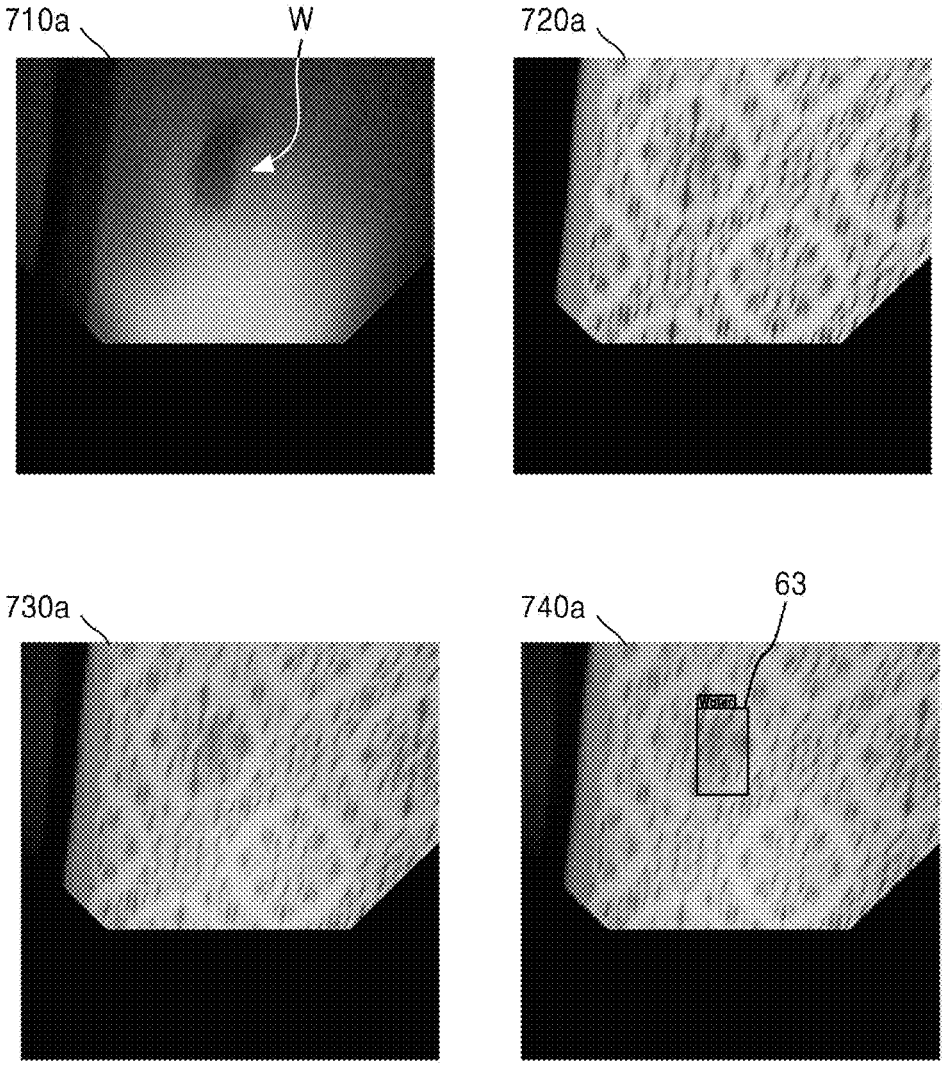
FIGS. 11A to 11C show images for describing a method, performed by a cleaning robot, of determining a liquid object on a surface to be cleaned, according to an embodiment of the present disclosure.
Figure 11B:
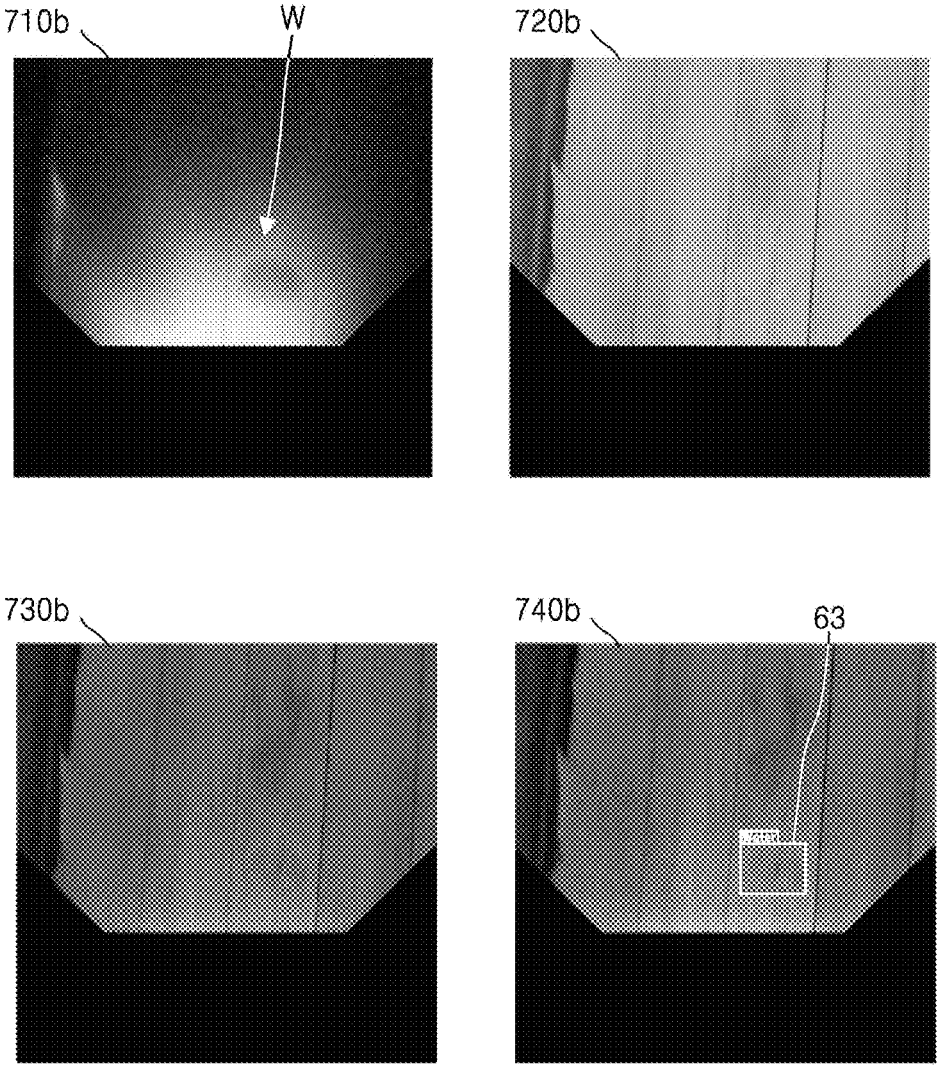
Figure 11C:
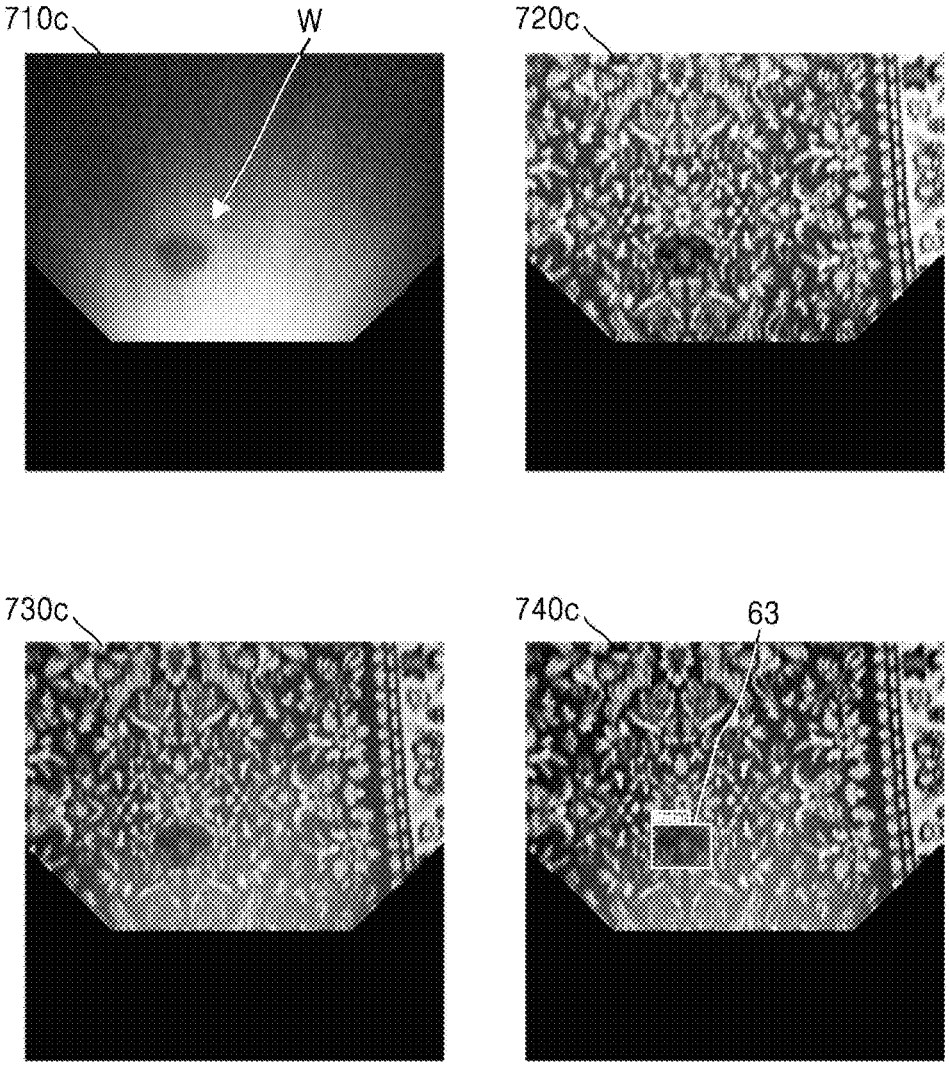

FIGS. 11A to 11C show images for describing a method, performed by the cleaning robot 1000, of determining a liquid object on a surface to be cleaned, according to an embodiment of the present disclosure.

Referring to FIGS. 11A to 11C, the cleaning robot 1000 may generate synthetic images 730*a*, 730*b*, and 730*c* by combining infrared light images 710*a*, 710*b*, and 710*c* and visible light images 720*a*, 720*b*, and 720*c*, which are obtained through conversion to grayscale, and obtain information about liquid objects that is output from a machine learning model by inputting the generated synthetic images 730*a*, 730*b*, and 730*c* to the machine learning model. In addition, the cleaning robot 1000 may generate determination result images 740*a*, 740*b*, and 740*c* in which a box image 63 indicating the positions of the liquid objects is indicated in the synthetic images 730*a*, 730*b*, and 730*c*.

Referring to FIG. 11B, even in a case where the surface to be cleaned is a wooden floor, the cleaning robot 1000 may accurately detect the position of liquid spilled on the wooden floor.

Referring to FIG. 11C, even in a case where the surface to be cleaned is a carpet, the cleaning robot 1000 may accurately detect the position of liquid in the carpet.

Figure 11D:
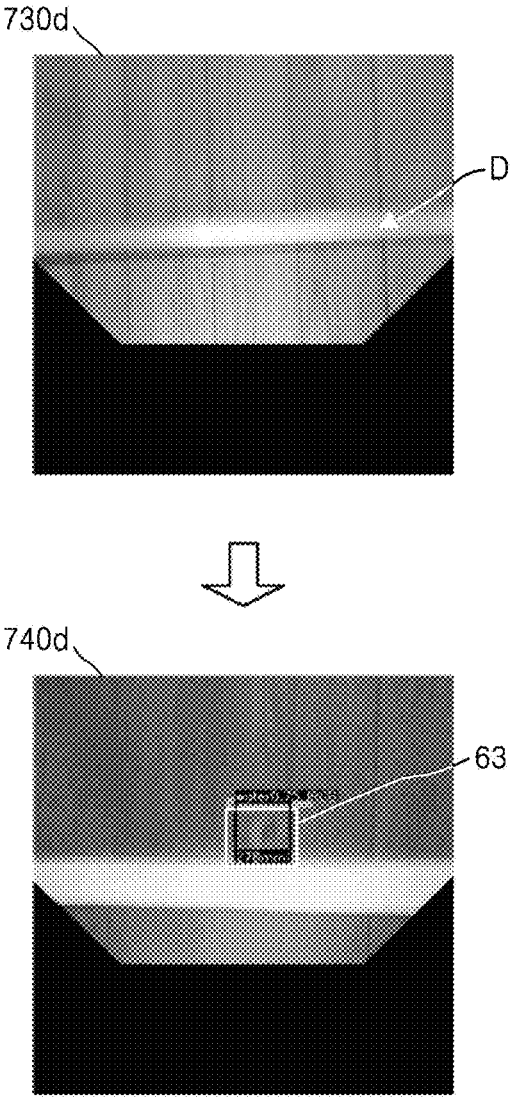
FIG. 11D shows images for describing a method, performed by a cleaning robot, of determining a liquid object on a surface to be cleaned, according to an embodiment of the present disclosure.

FIG. 11D illustrates a method, performed by the cleaning robot 1000, of determining whether a liquid object is present on a surface to be cleaned, according to an embodiment of the present disclosure.

Referring to FIG. 11D, even in a case where a captured image of a surface to be cleaned is not uniform because, for example, there is a step or an obstacle on the surface to be cleaned, the cleaning robot 1000 may determine the liquid object with high precision.

An upper image of FIG. 11D is a synthetic image 730*d* of the surface to be cleaned on which a step D is present. Although it is difficult to identify a liquid object in the synthetic image 730*d* of FIG. 11D with the naked eye, a liquid object is present above the step D. A lower image of FIG. 11D is a determination result image 740*d* generated based on an output of a machine learning model. The liquid object may be marked with a predetermined edge 63 in the determination result image 740*d*.

As such, even when an image of a surface to be cleaned is not uniform, the presence or absence of a liquid object may be determined with high precision. In particular, the determination is made based on not only an infrared light image but also a visible light image, the influence of a black color, a shadow, or the like may be reduced. In addition, the determination is made by using the completely trained machine learning model 23, and thus, the cleaning robot 1000 may determine a liquid object with high precision.

Figure 12:
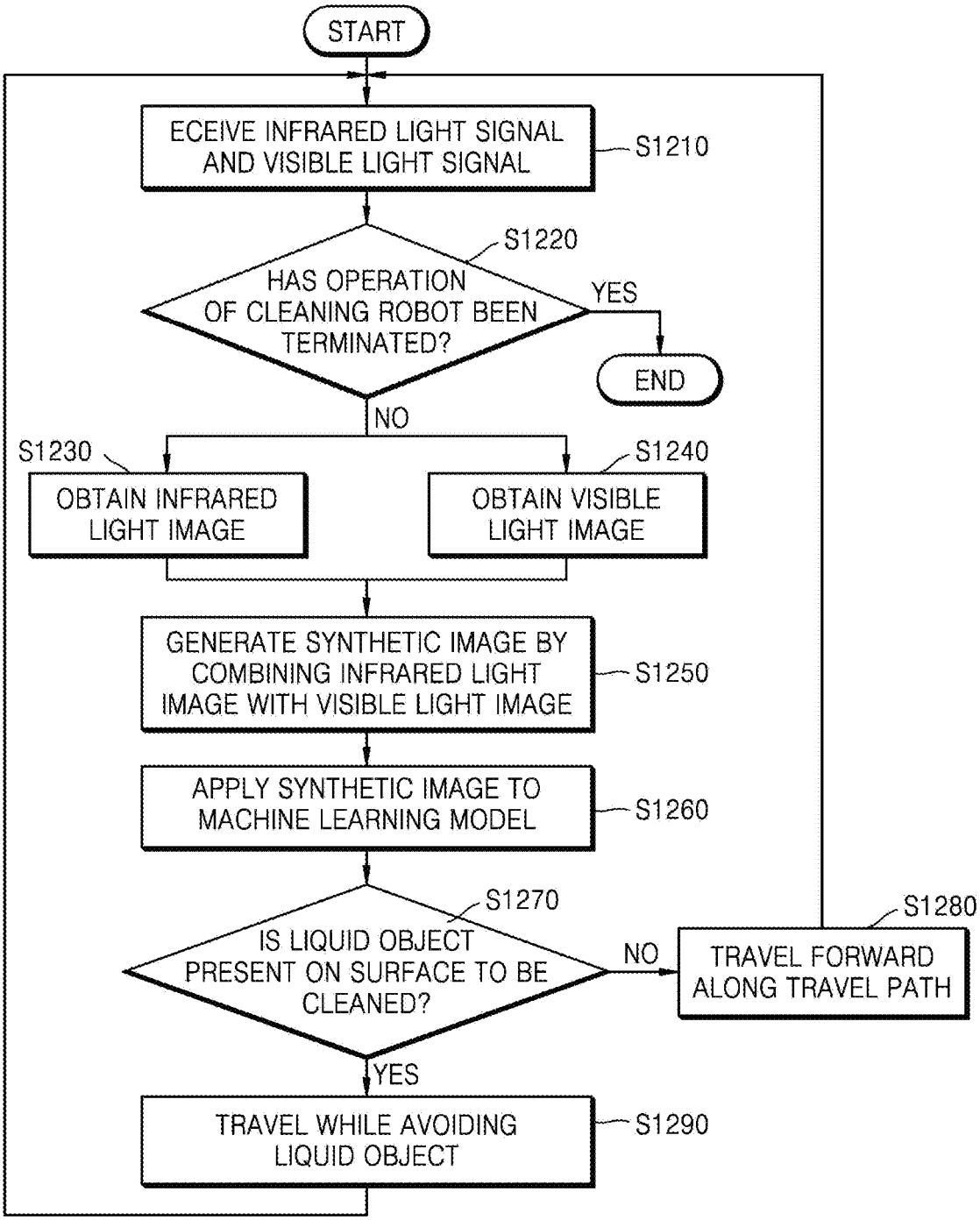
FIG. 12 is a flowchart of a method, performed by a cleaning robot, of detecting and avoiding a liquid object while traveling, according to an embodiment of the present disclosure.

FIG. 12 is a flowchart of a method, performed by the cleaning robot 1000, of detecting and avoiding a liquid object while traveling, according to an embodiment of the present disclosure.

In operation S1210, when the cleaning robot 1000 initiates an operation and travels, the cleaning robot 1000 may receive an infrared light signal and a visible light signal through the infrared light sensor and the visible light sensor.

In operation S1220, the cleaning robot 1000 may determine whether the operation of the cleaning robot 1000 has been terminated.

When it is determined in operation S1220 that the operation of the cleaning robot 1000 has not been terminated, the cleaning robot 1000 may obtain an infrared light image in operation S1230 and obtain a visible light image in operation S1240.

In operation S1250, the cleaning robot 1000 may generate a synthetic image by combining the infrared light image with the visible light image.

In operation S1260, the cleaning robot 1000 may apply the generated synthetic image to the completely trained machine learning model 23.

In operation S1270, the cleaning robot 1000 may determine whether a liquid object is present on a surface to be cleaned.

When it is determined in operation S1270 that no liquid object is present on the surface to be cleaned, the cleaning robot 1000 may travel forward along a travel path in operation S1280. For example, the cleaning robot 1000 may output a normal control signal to the traveling module to control the robot main body to move forward and travel as is.

When it is determined in operation S1270 that a liquid object is present on the surface to be cleaned, the cleaning robot 1000 may travel while avoiding the liquid object in operation S1290. For example, the cleaning robot 1000 may output a control signal for changing travel to the traveling module, and control the robot main body to travel while avoiding the region of the liquid object. The cleaning robot 1000 may execute operations S1210 to S1290 until the operation of the cleaning robot 1000 is terminated. Accordingly, even when a liquid object is present in the travel path, the robot main body may travel while avoiding the liquid object.

Figure 13:
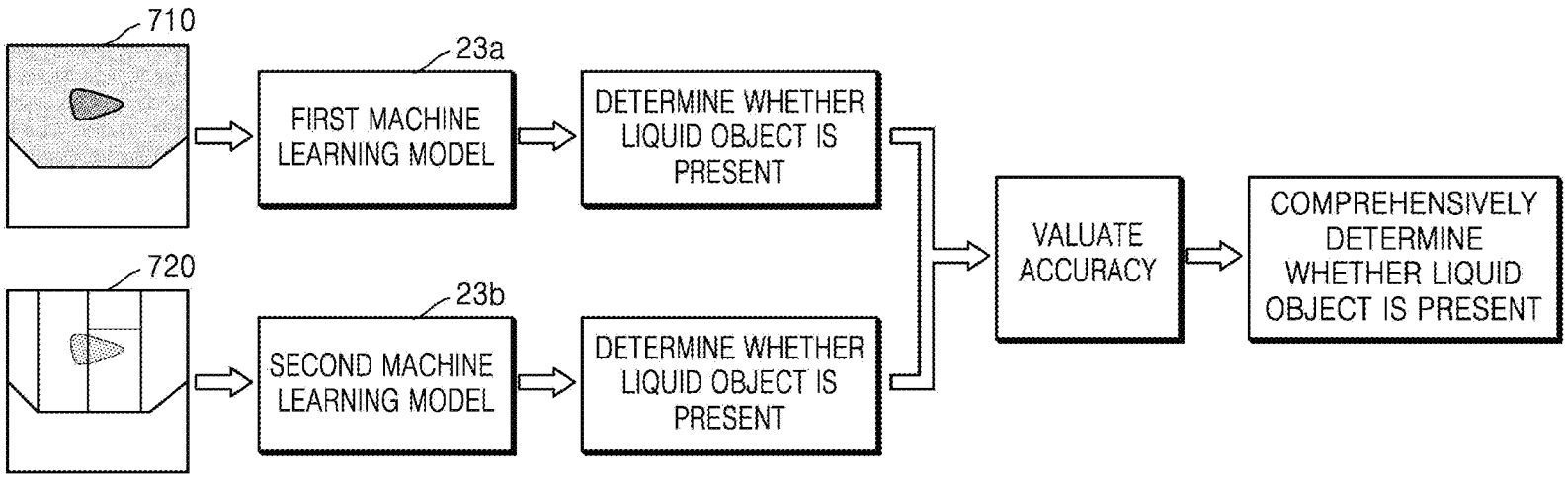
FIG. 13 illustrates a method, performed by a cleaning robot, of determining the presence or absence of a liquid object by using machine learning models, according to an embodiment of the present disclosure.

FIG. 13 illustrates a method, performed by the cleaning robot 1000, of determining the presence or absence of a liquid object by using machine learning models, according to an embodiment of the present disclosure.

Referring to FIG. 13, the cleaning robot 1000 determines the presence or absence of a liquid object in each of the infrared light image 710 and the visible light image 720, and comprehensively determines the presence or absence of a liquid object from each determination result. The cleaning robot 1000 improves determination accuracy by combining the determinations for the infrared light image 710 and the visible light image 720 to finally determine the presence or absence of a liquid object.

In detail, the cleaning robot 1000 may apply the infrared light image 710 to a first machine learning model 23*a* that is completely trained and corresponds to infrared light images, and perform a first determination process of determining the presence or absence of a liquid object on a surface to be cleaned, based on an output of the first machine learning model 23*a*.

In addition, the cleaning robot 1000 may apply the visible light image 720 to a second machine learning model 23*b* that is completely trained and corresponds to visible light images, and perform a second determination process of determining the presence or absence of a liquid object on the surface to be cleaned, based on an output of the second machine learning model 23*b*. In addition, the cleaning robot 1000 may comprehensively determine the presence or absence of a liquid object on the surface to be cleaned based on both the first determination process and the second determination process.

According to an embodiment of the present disclosure, the completely trained first and second machine learning models 23*a* and 23*b* corresponding to the infrared light image 710 and the visible light image 720, respectively, may be constructed by using an existing completely trained machine learning model. In addition, the completely trained machine learning models 23*a* and 23*b* may be stored in the memory of the cleaning robot 1000.

In addition, while the cleaning robot 1000 is traveling, the cleaning robot 1000 may control the infrared light sensor and the visible light sensor to photograph the surface to be cleaned in front of a travel path. The cleaning robot 1000 may obtain the infrared light image 710 and the visible light image 720 from the infrared light sensor and the visible light sensor.

The cleaning robot 1000 may determine the presence or absence of a liquid object based on the obtained infrared light image 710 (a first determination), and determines the presence or absence of a liquid object based on the obtained visible light image 720 (a second determination). When the first determination and the second determination match, the cleaning robot 1000 may finally determine the presence or absence of a liquid object based on the determinations that match.

On the contrary, when the first determination and the second determination are different from each other, the cleaning robot 1000 may evaluate the accuracy of the first determination and the second determination.

For example, the first machine learning model and the second machine learning model may output accuracy of information in addition to information about the presence or absence of a liquid object. Thus, the cleaning robot 1000 may select which determination to adopt from among the first determination and the second determination, by comparing the accuracies output from the first and second machine learning models 23*a* and 23*b* with a predetermined reference value or comparing the output accuracies with each other.

For example, when the first determination is that a liquid object is present, the second determination is that no liquid object is present, and the accuracy of the second determination is lower than the accuracy of the first determination, the cleaning robot 1000 may determine that a liquid object is present, based on the first determination.

Figure 14:
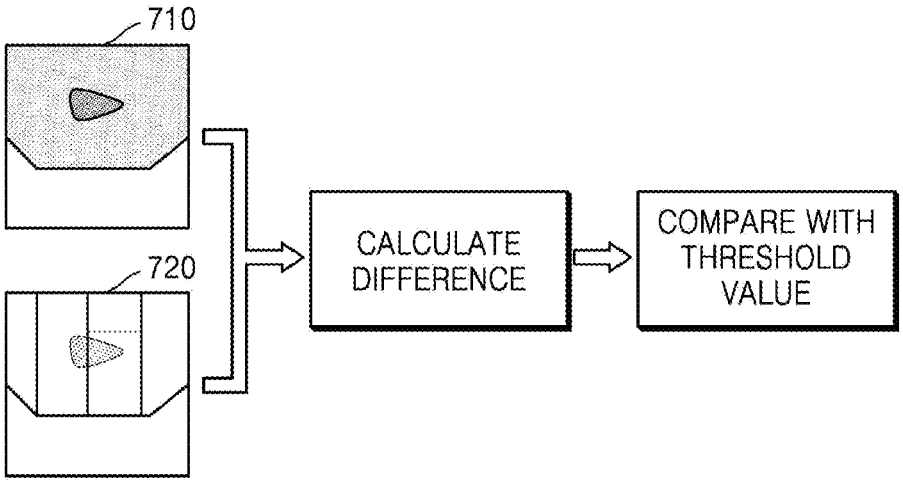
FIG. 14 illustrates a method, performed by a cleaning robot, of determining the presence or absence of a liquid object based on a difference between an infrared light image and a visible light image, according to an embodiment of the present disclosure.

FIG. 14 illustrates a method, performed by the cleaning robot 1000, of determining the presence or absence of a liquid object based on a difference between an infrared light image and a visible light image, according to an embodiment of the present disclosure.

In detail, the cleaning robot 1000 may determine the presence or absence of a liquid object by calculating a difference between an infrared light image and a visible light image and comparing the calculated difference with a predetermined threshold value.

Referring to FIG. 14, while the cleaning robot 1000 is traveling, the cleaning robot 1000 may control the infrared light sensor and the visible light sensor to photograph a surface to be cleaned in front of a travel path. The cleaning robot 1000 may receive the infrared light image 710 and the visible light image 720 from the infrared light sensor and the visible light sensor.

The cleaning robot 1000 may calculate a difference between the infrared light image 710 and the visible light image 720. The cleaning robot 1000 may compare the calculated difference with a predetermined threshold value. When the calculated difference is greater than or equal to the threshold value, the cleaning robot 1000 may determine that a liquid object is present on the photographed surface to be cleaned, and when the calculated difference is less than the threshold value, the cleaning robot 1000 may determine that no liquid object is present on the photographed surface to be cleaned.

According to an embodiment of the present disclosure, because illumination is not uniform in practice, places far from the cleaning robot 1000 appear dark in an infrared light image, the influence of the color of the surface to be cleaned in the visible light image needs to be considered, and thus, the cleaning robot 1000 may perform brightness correction according to distance or color before calculating a difference between the infrared light image and the visible light image.

A liquid object appears dark in an infrared light image with an absorption wavelength, and thus, in a case where a region of the surface to be cleaned that appears bright in a visible light image is a liquid object, the difference between the infrared light image and the visible light image may be high. Thus, in a case where a region that appears bright in the visible light image is the region of a liquid object on the surface to be cleaned, the cleaning robot 1000 may determine the presence or absence of the liquid object, and the region of the liquid object with high precision.

On the contrary, a black region or a shaded region on the surface to be cleaned appear dark in an infrared light image with an absorption wavelength even when no liquid object is present in the region. Thus, with only the infrared light image at the absorption wavelength, it is impossible to identify whether a dark region in the infrared light image is the region of a liquid object, a black portion, or a shaded portion, and thus, there is a possibility that a liquid object is misdetected.

In addition, a black or shaded region on the surface to be cleaned also appears dark in the visible light image. Thus, in a case where a region of the surface to be cleaned is a black or shaded region that is not a liquid object, the difference between the infrared light image and the visible light image is low.

In a case where a black or shaded region on the surface to be cleaned is the region of a liquid object, there is a high probability that it is determined that the black or shaded region is not the region of a liquid object, but there are few cases where only a black or shaded region is the region of a liquid object. Thus, the probability that the region of a liquid object is misdetected is low.

According to an embodiment of the present disclosure, the cleaning robot 1000 may determine the presence or absence of a liquid object and the region of the liquid object, based on only the infrared light image 710. For example, the cleaning robot 1000 may include the machine learning model 23 that is completely trained to, upon an infrared light image being input, output the presence or absence of a liquid object and the region of the liquid object, and may determine the presence or absence of a liquid object and the region of the liquid object by applying a captured infrared light image to the completely trained machine learning model 23.

Figure 15:
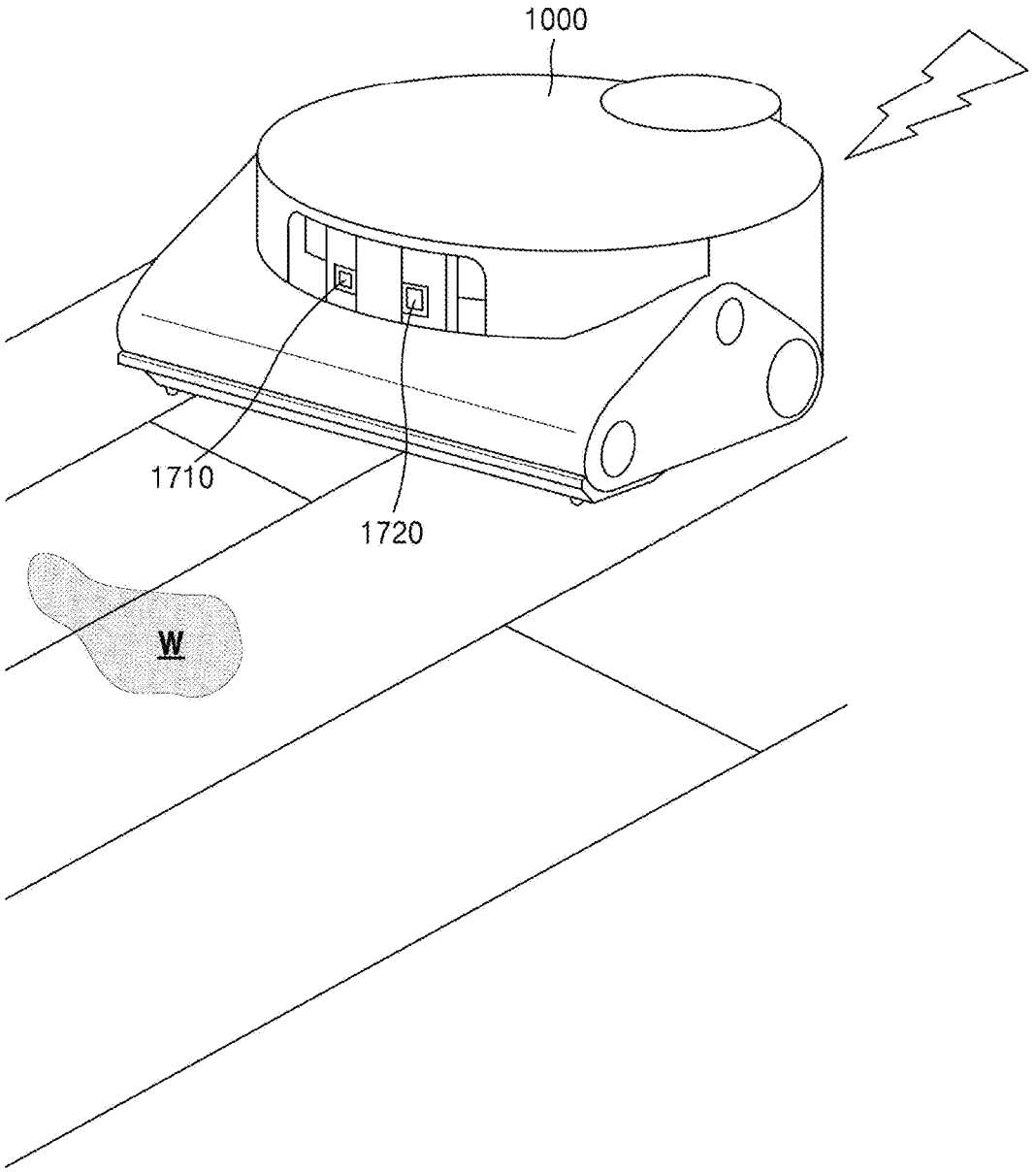
FIG. 15 illustrates a method, performed by a cleaning robot, of notifying that a liquid object is present in a region to be cleaned, according to an embodiment of the present disclosure.

FIG. 15 illustrates a method, performed by the cleaning robot 1000, of notifying that a liquid object is present in a region to be cleaned, according to an embodiment of the present disclosure.

Referring to FIG. 15, as the liquid object W is detected in front, the cleaning robot 1000 may output a notification that the liquid object W has been detected.

The cleaning robot 1000 may control the infrared light sensor 1710 and the visible light sensor 1720 to obtain an infrared light image and a visible light image of a surface to be cleaned in front. The cleaning robot 1000 may determine whether the liquid object W is present on the photographed surface to be cleaned, based on the obtained infrared light image and visible light image.

According to an embodiment of the present disclosure, when the liquid object W is present on the surface to be cleaned, the cleaning robot 1000 may output a voice or a notification sound notifying that the liquid object W is present in front, and then travel while avoiding the liquid object W.

In addition, according to an embodiment of the present disclosure, when the liquid object W is present on the surface to be cleaned, the cleaning robot 1000 may output a voice or a notification sound notifying that the liquid object W is present in front, then stop for a predetermined time period such that a user is aware of the position of the liquid object W, and then travel again while avoiding the liquid object W.

In addition, according to an embodiment of the present disclosure, based on the size of the liquid object W, the cleaning robot 1000 may determine whether to travel while avoiding the liquid object W, or whether to travel while sucking in the liquid object W along a set travel path. When the liquid object W is small, there is almost no risk of the cleaning robot 1000 becoming contaminated or the liquid object W spreading even when the liquid object W is sucked in, and thus, the cleaning robot 1000 may travel while avoiding the liquid object W only when the size of the liquid object W is greater than or equal to a predetermined reference size.

Figure 16:
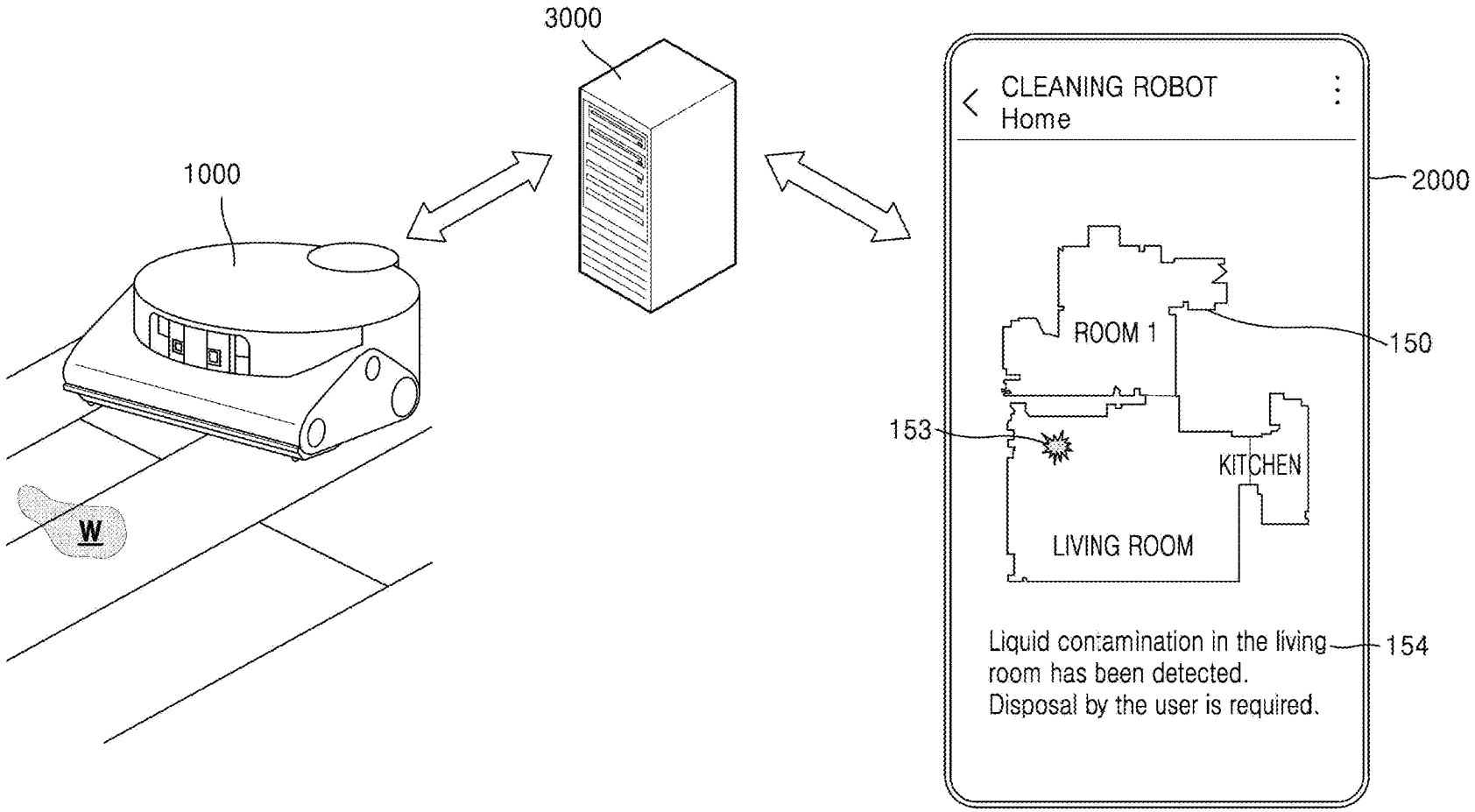
FIG. 16 illustrates a method, performed by a cleaning robot, of notifying, through a user device, that a liquid object is present in a region to be cleaned, according to an embodiment of the present disclosure.

FIG. 16 illustrates a method, performed by the cleaning robot 1000, of notifying, through a user device 2000, that a liquid object is present in a region to be cleaned, according to an embodiment of the present disclosure.

Referring to FIG. 16, the cleaning robot 1000 may output a notification that the liquid object W is present in a region to be cleaned, through the user device 2000.

Based on determining that the liquid object W is present in front, the cleaning robot 1000 may determine the position of the liquid object W on a map of the region to be cleaned, which is stored in the cleaning robot 1000. In addition, the cleaning robot 1000 may transmit the determined position of the liquid object W on the map, to a server 3000. In this case, the cleaning robot 1000 may transmit, to the server 3000, identification information of the cleaning robot 1000 and the position of the liquid object W on the map, based on previously stored address information of the server 3000.

The server 3000 may transmit, to the user device 2000, the position of the liquid object W on the map received from the cleaning robot 1000. In this case, the server 3000 may obtain identification information of the user device 2000 corresponding to the identification information of the cleaning robot 1000, and transmit the position of the liquid object W on the map to the user device 2000 based on the obtained identification information of the user device 2000.

According to an embodiment of the present disclosure, when the server 3000 receives the position of the liquid object W on the map from the cleaning robot 1000, the server 3000 may immediately transmit, to the user device 2000, a push notification that the liquid object W is present in the region to be cleaned.

In response to receiving the push notification from the server 3000, the user device 2000 may display the received push notification. Based on receiving a user input for selecting the displayed push notification, the user device 2000 may display a map 150 of the region to be cleaned and an image 153 indicating the position of the liquid object W on the map 150 of the region to be cleaned. In addition, the user device 2000 may display a phrase 154 indicating that the liquid object W is present in the region to be cleaned, or a phrase indicating that disposal of the liquid object W is required. In addition, the user device 2000 may display a captured image of the liquid object W. Accordingly, as soon as the cleaning robot 1000 detects the liquid object W while traveling, the user may recognize the presence of the liquid object W in the region to be cleaned, and check the position of the liquid object W, through the user device 2000.

According to an embodiment of the present disclosure, based on receiving a user input for selecting a menu for viewing cleaning information of the cleaning robot 1000, the user device 2000 may display the map 150 of the region to be cleaned and the image 153 indicating the position of the liquid object W on the map 150 of the region to be cleaned.

According to an embodiment of the present disclosure, the user device 2000 may display the image 153 indicating the position of the liquid object W along with an image indicating the travel path of the cleaning robot 1000 on the map 150 of the region to be cleaned.

Figure 17:
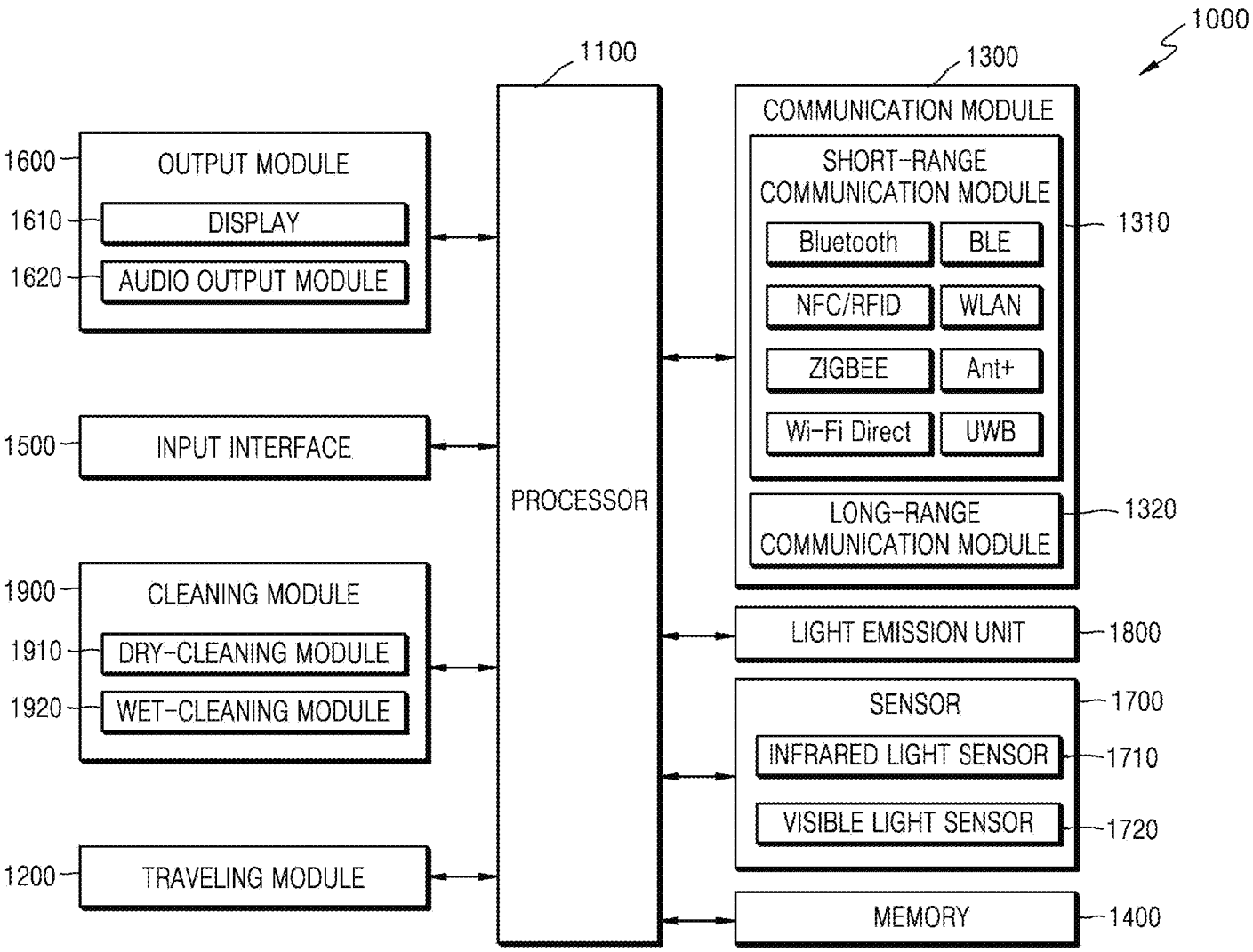
FIG. 17 illustrates a block diagram of a cleaning robot according to an embodiment of the present disclosure.

FIG. 17 illustrates a block diagram of the cleaning robot 1000 according to an embodiment of the present disclosure.

Referring to FIG. 17, the cleaning robot 1000 may include the processor 1100, the light emission unit 1800, a communication module 1300, the memory 1400, an input interface 1500, an output module 1600, a sensor 1700, the traveling module 1200, and the cleaning module 1900. The same reference numerals are used for components that are the same as those illustrated in FIG. 2.

All components illustrated in FIG. 17 are not essential components of the cleaning robot 1000. The cleaning robot 1000 may be implemented by more or less components than the components illustrate in FIG. 17.

The output module 1600 may include an audio output module 1620 and a display 1610.

The audio output module 1620 may output an audio signal to the outside of the cleaning robot 1000. The audio output module 1620 may include, for example, a speaker or a receiver. The speaker may be used for general purposes, such as reproducing multimedia or record.

The display 1610 may output image data processed by an image processor (not shown) through a display panel (not shown) under control of the processor 1100. The display panel (not shown) may include at least one of a liquid crystal display, a thin-film-transistor liquid-crystal display, an organic light-emitting diode, a flexible display, a three-dimensional (3D) display, and an electrophoretic display.

The input interface 1500 may receive a user input for controlling the cleaning robot 1000. The input interface 1500 receives a user input and transmits it to the processor 1100.

The input interface 1500 may include a user input electronic device including a touch panel for detecting a touch of the user, a button for receiving a push operation of the user, a wheel for receiving a rotation operation of the user, a keyboard, a dome switch, and the like, but is not limited thereto.

In addition, the input interface 1500 may include a speech recognition device for speech recognition. For example, the speech recognition device may be a microphone, and may receive a voice command or a voice request of the user. Accordingly, the processor 1100 may control an operation corresponding to the voice command or voice request to be performed.

The memory 1400 stores various pieces of information, data, instructions, programs, and the like necessary for an operation of the cleaning robot 1000. The memory 1400 may include at least one of volatile memory or non-volatile memory, or a combination thereof. The memory 1400 may include at least one of a flash memory-type storage medium, a hard disk-type storage medium, a multimedia card micro-type storage medium, card-type memory (e.g., SD or XD memory), random-access memory (RAM), static RAM (SRAM), read-only memory (ROM), electrically erasable programmable ROM (EEPROM), programmable ROM (PROM), magnetic memory, a magnetic disc, and an optical disc. In addition, the cleaning robot 1000 may operate a web storage or a cloud server that performs a storage function on the Internet.

The communication module 1300 may transmit and receive information to and from an external device or an external server according to a protocol under control of the processor 1100. The communication module 1300 may include at least one communication module configured to transmit and receive data to and from an external device (not shown), and at least one port.

In addition, the communication module 1300 may perform communication with an external device through at least one wired or wireless communication network. The communication module 1300 may include at least one of a short-range communication module 1310 or a long-range communication module 1320, or a combination thereof. The communication module 1300 may include at least one antenna for wireless communication with other devices.

The short-range communication module 1310 may include at least one communication module (not shown) configured to perform communication according to a communication standard, such as Bluetooth, Wi-Fi, Bluetooth Low Energy (BLE), Near-field communication (NFC)/radio-frequency identification (RFID), Wi-Fi Direct, ultra-wideband (UWB), or Zigbee. In addition, the long-range communication module 1320 may include a communication module (not shown) configured to perform communication through a network for Internet communication. In addition, the long-range communication module 1320 may include a mobile communication module configured to perform communication according to a communication standard, such as $3^{rd}$ Generation (3G), $4^{th}$ Generation (4G), $5^{th}$ Generation (5G), and/or $6^{th}$ Generation (6G).

In addition, the communication module 1300 may include a communication module capable of receiving a control command from a remote controller (not shown) at a short distance, for example, an IR communication module.

The cleaning module 1900 may include a dry-cleaning module 1910 and a wet-cleaning module 1920. The dry-cleaning module 1910 may include a brush, a dust container, a dust separator, a suction motor, and the like. The wet-cleaning module 1920 may include a mop pad, a mop pad motor, a mop pad up-down device module, a water container, a water supply motor, and the like.

The suction motor (or a vacuum motor) may suck in air through a suction port of the cleaning robot 1000 by rotating a fan connected to the suction motor.

The brush may be a bristle brush having a plurality of bristles or a cotton flannel brush having cotton flannel, but is not limited thereto. The brush may be rotated by a driving force transmitted from the brush motor. The brush may sweep dust or foreign substances stuck on a floor and move them to the suction port of the cleaning robot 1000.

The dust sucked in through the suction port of the cleaning robot 1000 and then filtered out by the dust separator may be stored in the dust container.

The mop pad motor may perform wet mopping by moving the mop pad attached to the cleaning robot 1000. The mop pad up-down device module may perform a pad-up operation of bringing the mop pad in close contact with a floor into close contact with the cleaning robot 1000, or a pad-down operation of bringing the mop pad in close contact with the cleaning robot 1000 into close contact with a floor.

The sensor 1700 may include various types of sensors.

For example, the sensor 1700 may include the infrared light sensor 1710 and the visible light sensor 1720. According to an embodiment of the present disclosure, the sensor 1700 may include an obstacle sensor, an object sensor, and a fall prevention sensor.

The obstacle sensor may output infrared or ultrasonic waves and receive reflected signals reflected from an obstacle. The processor 1100 may control the obstacle sensor to detect whether an obstacle is present in front.

The object sensor may include a two-dimensional camera sensor and a 3D camera sensor. In addition, the visible light sensor 1720 may operate as an object sensor. The object sensor may capture an image of the front of the cleaning robot 1000 and identify the types and positions of objects in the captured image.

The fall prevention sensor may include an infrared light emitting unit and an infrared light receiving unit both provided toward the floor. The processor 1100 may control the infrared light emitting unit of the fall prevention sensor to output infrared rays toward the floor, and control the infrared light receiving unit to receive a reflection signal reflected from the floor. The processor may detect the distance between the cleaning robot 1000 and the floor based on the received reflection signal. In addition, the processor 1100 may identify the possibility of a fall, and a door threshold based on the distance to the floor.

In addition, the sensor 1700 may include a plurality of sensors configured to detect information about environments around the cleaning robot 1000. For example, the sensor 1700 may include an ultrasonic sensor, a motion sensor, and the like, but is not limited thereto.

At least one processor 1100 may control the light emission unit 1800 to emit light having, as a peak wavelength, an absorption wavelength that is determined based on the absorption characteristics of water, toward a surface to be cleaned in a traveling direction of the cleaning robot 1000.

The at least one processor 1100 may receive infrared light having the absorption wavelength among light reflected from the surface to be cleaned, through the infrared light sensor 1710.

The at least one processor 1100 may receive visible light reflected from the surface to be cleaned, through the visible light sensor 1720.

The at least one processor 1100 may determine whether a liquid object is present on the surface to be cleaned, based on the received infrared light and visible light.

Based on determining that a liquid object is present on the surface to be cleaned, the at least one processor 1100 may control the traveling module 1200 to move the cleaning robot 1000 to avoid the liquid object.

The absorption wavelength may range between 930 nm and 1030 nm.

The infrared light sensor 1710 may include a band-pass filter for blocking visible light and receiving light having the absorption wavelength.

The at least one processor 1100 may generate an infrared light image of the surface to be cleaned based on an intensity signal of the received infrared light obtained from the infrared light sensor 1710.

The at least one processor 1100 may generate a visible light image of the surface to be cleaned based on an intensity signal of the received visible light obtained from the visible light sensor 1720.

The at least one processor 1100 may determine whether a liquid object is present on the surface to be cleaned, based on the infrared light image and the visible light image.

The at least one processor 1100 may generate a synthetic image by combining the infrared light image with the visible light image.

The at least one processor 1100 may determine whether a liquid object is present on the surface to be cleaned, based on a region of the liquid object in the visible light image that is output from a machine learning model upon the synthetic image being input to the machine learning model.

The at least one processor 1100 may identify whether a liquid object is present on the surface to be cleaned, based on a region of a liquid object in the infrared light image that is output from a first machine learning model upon the infrared light image being input to a first machine learning model as input, and a region of a liquid object in the visible light image that is output from a second machine learning model upon the visible light image being input to a second machine learning model as input.

The at least one processor 1100 may determine whether a liquid object is present on the surface to be cleaned, based on a difference image between the infrared light image and the visible light image.

Based on determining that a liquid object is present on the surface to be cleaned, the at least one processor 1100 may output a notification that the liquid object is present on the surface to be cleaned.

Based on determining that a liquid object is present on the surface to be cleaned, the at least one processor 1100 may transmit a notification that the liquid object is present on the surface to be cleaned, to a user device through a server.

Based on the cleaning robot 1000 detecting a liquid object on the surface to be cleaned on the travel path while moving along a travel path, the at least one processor 1100 may change the travel path to avoid the liquid object.

A machine-readable storage medium may be provided in the form of a non-transitory storage medium. Here, the term 'non-transitory storage medium' refers to a tangible device and does not include a signal (e.g., an electromagnetic wave), and the term 'non-transitory storage medium' does not distinguish between a case where data is stored in a storage medium semi-permanently and a case where data is stored temporarily. For example, the 'non-transitory storage medium' may include a buffer in which data is temporarily stored.

According to an embodiment, methods according to various embodiments disclosed herein may be included in a computer program product and then provided. The computer program product may be traded as commodities between sellers and buyers. The computer program product may be distributed in the form of a machine-readable storage medium (e.g., a compact disc ROM (CD-ROM) or a universal Serial Bus (USB) flash drive), or may be distributed online (e.g., downloaded or uploaded) through an application store or directly between two user devices (e.g., smart phones). In a case of online distribution, at least a portion of the computer program product (e.g., a downloadable app) may be temporarily stored in a machine-readable storage medium such as a manufacturer's server, an application store's server, or a memory of a relay server.

The invention claimed is:

1. A cleaning robot comprising:

a cleaning module;

a traveling module configured to move the cleaning robot on a surface to be cleaned;

a light emission unit;

an infrared light sensor;

a visible light sensor; and at least one processor configured to execute one or more instructions to:

control the light emission unit to emit infrared light toward a detection region on the surface to be cleaned in front of the cleaning robot, control the infrared light sensor to receive the emitted infrared light that is reflected from the detection region, control the visible light sensor to receive visible light reflected from the detection region, generate an infrared light image corresponding to the intensity of the reflected infrared light received by the infrared light sensor, generate a visible light image corresponding to the intensity of the reflected visible light received by the visible light sensor, determine whether a liquid object is present in the detection region based on the generated infrared light image and the generated visible light image, control, based on determining that the liquid object is present in the detection region, the traveling module to move the cleaning robot to avoid the liquid object, and control the cleaning module to clean the surface to be cleaned while the cleaning robot is moved to avoid the liquid object.

2. The cleaning robot of claim 1, wherein the at least one processor is configured to:

calculate, based on the intensity of the reflected infrared light received by the infrared light sensor, a reflectance of the infrared light emitted from the light emission unit, and determine, based on whether the calculated reflectance of the infrared light emitted from the light emission unit is greater than or equal to a threshold reflectance, the generated infrared light image, and the generated visible light image, whether the liquid object is present in the detection region.

3. The cleaning robot of claim 2, wherein the light emission unit includes a light source at a height at which a reflectance of a surface of a liquid object in the detection region is greater than or equal to the threshold reflectance.

4. The cleaning robot of claim 1, wherein the at least one processor is configured to:

control the light emission unit to emit light having, as a peak wavelength, an absorption wavelength that is determined based on absorption characteristics of water, and receive, through the infrared light sensor, infrared light with the absorption wavelength among light reflected from the detection region.

5. The cleaning robot of claim 4, wherein the absorption wavelength ranges between 930 nm and 1030 nm.

6. The cleaning robot of claim 4, wherein the infrared light sensor includes a band-pass filter to block visible light and receive infrared light with the absorption wavelength.

7. The cleaning robot of claim 1, wherein the at least one processor is configured to:

generate a synthetic image by combining the generated infrared light image with the generated visible light image, obtain a region of the liquid object in the generated visible light image by applying the generated synthetic image to a machine learning model, and determine, based on a region of the liquid object in the generated visible light image, whether the liquid object is present in the detection region.

8. The cleaning robot of claim 1, wherein the at least one processor is configured to:

output, based on determining that the liquid object is present in the detection region, a notification that the liquid object is present in the detection region.

9. The cleaning robot of claim 1, wherein the at least one processor is configured to:

transmit, based on determining that the liquid object is present in the detection region, a notification, through a server to a user device, that the liquid object is present in the detection region.

10. A method of controlling a cleaning robot to avoid a liquid object, the cleaning robot including a cleaning module, a traveling module configured to move the cleaning robot on a surface to be cleaned, a light emission unit, an infrared light sensor, and a visible light sensor, the method comprising:

emitting infrared light toward a detection region on the surface to be cleaned in front of the cleaning robot;

receiving, by the infrared light sensor, the emitted infrared light that is reflected from the detection region;

receiving, by the visible light sensor, visible light reflected from the detection region;

generating an infrared light image corresponding to the intensity of the reflected infrared light received by the infrared light sensor;

generating a visible light image corresponding to the intensity of the reflected visible light received by the visible light sensor;

determining whether a liquid object is present in the detection region based on the generated infrared light image and the generated visible light image;

controlling, based on determining that the liquid object is present in the detection region, the traveling module to move the cleaning robot to avoid the liquid object; and controlling the cleaning module to clean the surface to be cleaned while the cleaning robot is moved to avoid the liquid object.

11. The method of claim 10, wherein the determining of whether the liquid object is present in the detection region includes:

calculating, based on the intensity of the reflected infrared light received by the infrared light sensor, a reflectance of the infrared light emitted from the light emission unit, and determining, based on whether the calculated reflectance of the infrared light emitted from the light emission unit is greater than or equal to a threshold reflectance, the generated infrared light image, and the generated visible light image, whether the liquid object is present in the detected region.

12. The method of claim 10, wherein the emitting of the infrared light includes emitting light having, as a peak wavelength, an absorption wavelength that is determined based on absorption characteristics of water, and the receiving of the infrared light reflected from the detection region includes receiving infrared light with the absorption wavelength among light reflected from the detection region.

13. The method of claim 12, wherein the absorption wavelength ranges between 930 nm and 1030 nm.

14. The method of claim 12, wherein the infrared light sensor includes a band-pass filter to block visible light and receive infrared light with the absorption wavelength.

15. The method of claim 10, wherein the determining, based on the generated infrared light image and the generated visible light image, whether the liquid object is present in the detection region includes:

generating a synthetic image by combining the generated infrared light image with the generated visible light image, obtaining a region of the liquid object in the generated visible light image by applying the generated synthetic image to a machine learning model, and determining, based on a region of the liquid object in the generated visible light image, whether the liquid object is present in the detection region.

16. The method of claim 10, further comprising:

outputting, based on determining that the liquid object is present in the detection region, a notification that the liquid object is present in the detection region.

17. The method of claim 10, further comprising:

transmitting, based on determining that the liquid object is present in the detection region, a notification, through a server to a user device, that the liquid object is present in the detection region.

* * * * *